US005750253A

United States Patent [19]

Satake et al.

[11] Patent Number: 5,750,253

[45] Date of Patent: May 12, 1998

[54] PRINTING PAPER AND NEWSPRINT PAPER WITH IMPROVED WATER ABSORPTIVITY AND THE MANUFACTURING PROCESS

[75] Inventors: Toshimi Satake; Toshiyuki Takano; Motoi Fukuda; Yukiko Uehori, all of Tokyo, Japan

[73] Assignee: Nippon Paper Industries Co., Ltd., Tokyo, Japan

[21] Appl. No.: 579,942

[22] Filed: Dec. 28, 1995

[30] Foreign Application Priority Data

Dec. 28, 1994 [JP] Japan ..... 6-339083
Dec. 6, 1995 [JP] Japan ..... 7-344832

[51] Int. Cl.[6] ..... B32B 23/08

[52] U.S. Cl. ..... 428/342; 428/478.8; 428/479.3; 428/479.6; 428/510; 162/168.3; 162/164.7

[58] Field of Search ..... 428/340, 341, 428/342, 507, 478.8, 479.3, 479.6, 510; 162/164.7, 168.1, 168.3, 164.1

[56] References Cited

U.S. PATENT DOCUMENTS 4,135,969 1/1979 Cosper ..... 162/167
5,470,918 11/1995 Tsutumi et al. ..... 525/329.2

FOREIGN PATENT DOCUMENTS 52-148211 12/1977 Japan .
54-73910 6/1979 Japan .
56-118995 9/1981 Japan .
62-122781 6/1987 Japan .
62-146674 6/1987 Japan .
64-1778 A 1/1989 Japan .
2-5040 1/1990 Japan .
4-289293 10/1992 Japan .
7-119078 5/1995 Japan .
7-138898 5/1995 Japan .

OTHER PUBLICATIONS

"Recent Advances of Paper Strengthening Agent: *The new mechanism of dry-strength development; The concept of anionic and cationic polyacrylamide mixing system*", Pulp and Paper Technology Associate of Japan, vol. 45, No.2, (1991) pp. 29–33.

*Primary Examiner*—Paul J. Thibodeau
*Assistant Examiner*—D. Lawrence Tarazano
*Attorney, Agent, or Firm*—Knobbe, Martens, Olson & Bear, LLP

[57] ABSTRACT

Printing paper such as newspaper printing paper, the water absorbency of which is controlled by coating material for controlling water absorbency on the surface of base paper, wherein the coating material contains component A which is at least one water-soluble polyacrylamide selected from nonionic polyacrylamides, cationic polyacrylamides, and water-soluble polyacrylamides, and component B which is water-soluble anionic polymers of monomers having hydrophobic substitute(s) and monomers having at least carboxyl group(s) or sulfone group(s).

15 Claims, No Drawings

PRINTING PAPER AND NEWSPRINT PAPER WITH IMPROVED WATER ABSORPTIVITY AND THE MANUFACTURING PROCESS

BACKGROUND

1. Field of the Invention

The present invention relates to printing paper, particularly to newsprint paper, with improved water absorptivity, and the manufacturing method thereof.

2. Background of the Art

Recently, technology of printing has been remarkably improved through the introduction of offset printing, color printing, high-speed, large-scale printing, automation, etc. With such progress, improvement in physical properties of printing paper is necessary from the viewpoints of workability, printing adaptability, etc.

In general, newsprint paper (paper for printing newspaper, a roll of newsprint) is mainly composed of mechanical pulp and deinked pulp ("deinked pulp" is abbreviated as "DIP" hereinafter) and classified into medium-grade paper or low-grade paper. Newsprint paper is, however, required to satisfy quality requirements stricter than those for general printing paper, since a specified number of newspapers must be printed in a specified duration of time in a specified time zone with certainty in newspaper printing. Newsprint paper is special paper from such a viewpoint, thus a special classification is applied to it. In addition, since a reduction in weight, an increase in content of DIP, etc. are further required for newsprint paper, improvement to satisfy all these needs is required. Thus, improvement of newsprint paper requires a much higher level of advanced technology as compared with that of general printing paper.

Recently, in the field of printing technology for newspapers, transition from relief printing to off-set printing has rapidly proceeded together with the introduction of computer systems into printing of newspapers, in order to respond to the necessity of an increase in printing speed, coloring of the paper, various kinds of printing, and automation.

In addition, newsprint paper used for offset printing is required to have different qualities from those used for relief printing. These quality requirements include that (1) paper should have wet strength and not suffer from water break; (2) paper should retain adequate water absorptivity; and (3) paper powder should not be generated. Among these quality requirements, preservation of water absorptivity, in other words, water absorptivity control, or provision of sizing property is a critical target. Under such circumstances, similar properties are desirable for general printing paper.

Water absorptivity has been conventionally controlled in general printing paper by using means to add agents such as sizing agents into the inside of paper (internal addition sizing) or to add the agents to the outside of paper (external addition sizing). Internal addition is a means of adding agents to pulp slurry at a so-called "wet-end" and make the agents to be contained in the inside of paper simultaneously with paper manufacturing. External addition is a means of coating sizing agents onto the surface of paper using coating machines represented by a two-roll size press and a gate roll coater following paper manufacture.

As sizing agents for internal addition, rosin sizing agents, emulsion-type sizing agents, synthetic sizing agents, etc. are known for acid paper, and alkylketene dimers (AKD) and alkenyl succinic anhydride (ASA) etc. for neutral paper. For example, Japanese Patent Application Laid-Open No. 60-88196 and No. 4-363301 disclose sizing agents comprising cationized starch and alkylketene dimers.

As sizing agents for external addition (also called as surface sizing agents), anionic polymers such as styrene/maleic acid copolymers and styrene/acrylic acid copolymers; anionic low molecular weight compounds such as alkyd resin saponification products of rosin, tall oil, and phthalic acid and saponification products of petroleum resin and rosin; cationic polymers such as styrene polymers and isocyanate polymers are known.

At present, water absorption of newsprint paper is controlled by, for example, (a) internal addition of agents such as sizing agents and water-proofing agents, (b) alteration of the composition of raw materials, and (c) alteration of paper-manufacturing conditions. Problems to be Solved by the Invention.

When means of internal addition of agents such as sizing agents generally employed for general printing paper (internal sizing) was introduced in order to control water absorptivity of newsprint paper, it was difficult to control the amounts of agents to be added so that addition of excessive amounts was required to maintain effective levels, because (1) agents should be added to pulp slurry of low concentration; (2) amounts of agents to be fixed on pulp sheet are not constant (amounts of agents fixed are low); (3) circulatory white water is employed, etc. Such excessive addition tends to cause a reduction in paper strength, machine trouble, noticeable stain of white water system, etc., and is problematic in cost, quality, operation condition etc.

Alteration of the composition of raw materials and paper manufacturing conditions can be applied only as short-term measures, but it is not appropriate for long-term measures, because, for example, remarkable alteration of raw materials may occur in actual machines.

As means of controlling water absorptivity of newsprint paper, application of external addition of agents used for general printing paper (external addition sizing) is also considered.

On-machine coating has been generally employed for coating surface-treatment agents onto the surface of newsprint paper for economic reasons and a gate roll coater using a coating formation and transcription system, which enables high-speed coating, has commonly been used. Characteristics of the gate roller coating method is simply summarized in, for example, Japan TAPPI Journal 43 (4), p. 36, 1989 and Paper Pulp Technology Times Vol. 36, No. 12, p. 20, 1993. The method enables coating liquid to be retained on the surface of paper and is more effective for improvement of paper surface, as compared with a conventional two-roll size press method. In the two-roll size press method, since base paper passes through a pond (liquid pool) of coating liquid, the coating liquid penetrates into base paper very deeply. However, in the gate roll coating method, since coating liquid preforms the coating, which is then transcribed, coating liquid does not substantially penetrate into base paper. Thus, in the gate roll coating method, coating material tends to remain on the surface of base paper and efficient improvement of paper surface can be achieved.

Coating by the gate roll coating method, however, has a defect in that sufficient sizing effect or addition of water absorptivity is not attained using conventional surface sizing agents, probably because coating liquid does not penetrate into base paper.

Furthermore, "improvement of surface strength" is one of the critical objects of external addition of agents, especially for newsprint paper, and thus, a reduction in weight, an increase in content of DIP, etc. can be mentioned as recent trends in newsprint paper itself.

As for a reduction in weight of newsprint paper, for example, in Japan, paper with a basis weight of 46 g/m$^2$ accounted for 96% of newsprint paper in 1989, but paper with a basis weight of 43 g/m$^2$ has increased to account for as high as approximately 80% in 1993. With progress towards a reduction in weight of paper, problems such as an decrease in opaqueness of newsprint paper and a reduction in paper strength, etc. have arisen, and increases in amounts of fillers and pigments are required to cope with these problems. However, the increases in amounts of these components together with a tendency of newsprint paper itself towards being thinner and lighter cause the phenomenon that added components are easily released from the surface of paper. This problem becomes more serious as the reduction in paper weight. For example, improvement of paper with a basis weight lower than 46 g/m$^2$ is a more difficult problem to be solved than that of paper with a basis weight not higher than 46 g/m$^2$. At the same time, an increase in DIP content caused increases in amounts of components such as microfibers fillers, and pigments derived from DIP, which in turn cause problems such as dropping of paper powder and a reduction in paper strength. These problems also become more serious as the composition ratio of DIP increases.

As mentioned above, recent trends in newsprint paper work as serious disadvantageous factors, especially in surface strength.

There are roughly two means known to improve the surface strength of newsprint paper: those not using coating and those using coating. Namely, the means not using coating comprises alteration of raw material composition, alteration of paper manufacturing conditions, and an increase in amounts of paper strength reinforcing agents. However, it is difficult to comply with strict quality requirements for newsprint paper used for offset printing by relying only on such means. However, coating means are effective for improving surface strength, since it is a method of coating surface treatment agents such as starch, modified starch (oxidized starch, starch derivatives, etc.), and polyvinyl alcohol (abbreviated as "PVA" hereinafter) on the surface of newsprint paper (external addition).

However, although external addition of surface treatment agents such as starch, modified starch (oxidized starch, starch derivatives, etc.), and PVA performed as measures to improve surface strength is certainly effective for improving surface strength, it cannot improve water absorptivity.

In addition, when large amounts of the agents are added externally, the agents moistured with water exhibit adhesiveness. Therefore, the external addition method may cause adhesive trouble (which is so called "Neppari") during manufacturing or printing of newsprint paper. This adhesion trouble is a more pronounced and serious problem when the gate roll coating method is employed for coating than when the two-roll size press method is employed. Thus, in using agents for external addition it is also necessary to consider that they should be selected so as to produce coated products with low adhesiveness and excellent peelability.

Surface sizing agents for newsprint paper are disclosed in the Japanese Patent Application Laid-Open Nos. 7-119078 and 7-138898. Japanese Patent Application Laid-Open No. 7-119078 discloses a surface sizing agent containing keten dimer as an effective component, while Japanese Patent Application Laid-Open No. 7-138898 discloses a one containing substituted succinic anhydride. These agents disclosed in the above Applications are considered to be combined AKD or ASA used for paper for general printing with surface strengtheners such as starch, PVA, etc. However, because AKD or ASA decreases friction coefficients, a serious problem results when using these surface sizing agents. Even if an antislipping agent is blended into coating materials containing AKD or ASA, it is not preferable for the possibility of lack of the agent during printing.

Since surface sizing agents used for general printing paper have been insufficiently effective for improving surface strength if they are considered as surface strength reinforcing agents, the present invention aims at providing printing paper, especially newsprint paper, in which both water absorptivity (sizing property) and surface strength are improved in a good balance.

According to the present invention, conventional problems have been solved by providing a water absorptivity controlling layer mainly comprising cationic polyacrylamides and anionic water-soluble polymers on base paper for printing paper. The method of the present invention is illustrated for use in newsprint paper hereinafter, since the method is effective especially for newsprint paper. The present invention is not restricted to newsprint paper, however, since this method is applicable to general printing paper.

Although coating nonionic polyacrylamides, cationic polyacrylamides (for example, water-soluble polyacrylamides with tertiary-amine group(s) and/or quaternary ammonium base(s)), or amphoteric polyacrylamides alone on base paper for newsprint paper can improve surface strength, water absorptivity cannot be improved. For example, if oxidized starch is coated on newsprint paper in amounts in a range of 0.5–1.0 g/m$^2$, the level of water absorptivity of the coated paper corresponds to approximately several seconds according to a spot water absorbing capacity test method mentioned below, and is insufficient.

A coating of copolymers with anionic hydrophobic group (s) alone is insufficiently effective for improving surface strength and it could not improve water absorptivity when coated in amounts not adversely affecting peelability of the coated product.

The effects of the water absorptivity controlling layer of the present invention are considered to depend on such an ionic complex. Application of such an ionic complex to agents for paper is described, for example, in Japan TAPPI Journal Vol. 45, No. 2, pp. 245–249, 1991, which discloses a method in which paper strength reinforcing agents are added to pulp slurry, wherein an ionic complex of high molecular weight was formed by mixing anionic paper strengthening agents and cationic paper strengthening agents. This method is, however, basically a method of internal addition of agents, and it does not aim at improving water absorptivity. Japanese Patent Application Laid-Open No. 60-119297, for example, describes a method of sizing paper by using anionic hydrophobic sizing agents and cationic retaining agents. However, this method is also a method of internal addition of agents, and thus it cannot solve the above-mentioned problems associated with internal addition.

On the other hand, Japanese Patent Application Laid-Open No. 52-148211, No. 56-118995, No. 3-54609, etc. disclose methods of surface sizing using coating liquid containing anionic resins and cationic resins. In particular, Japanese Patent Application Laid-Open No. 52-148211 describes a method of producing reinforced core paper for corrugated paper using coating liquid containing anionic resins and cationic resins. This method, however, aims mainly at improving compressive strength and rigidity but not at improving water absorptivity. In examples of the specification, the agents were coated in an amount of about 10 g/m$^2$, which level is far from that applicable to general printing paper. Japanese Patent Application Laid-Open No. 3-54609 describes a method of manufacturing oil-proof paper using surface sizing agents comprising, for example, oxidized starch, vinylidene chloride/acrylamide copolymers, and polyethyleneimine. Although oil-proof paper is required to have resistance against oil, the printing paper of the present invention is required to have absorptivity for ink (in other words, oil) to cope with high-speed printing in off-set printing. Therefore, the technology disclosed in the above-mentioned specification is quite opposite to that disclosed in the present invention, and thus it is impossible to apply the technology to the present invention. Japanese Patent Application Laid-Open No. 3-54609 discloses surface sizing agents comprising three components, namely, ketene dimers, cationized starch, anionic polymers, but the surface sizing agents had a problem of a reduction in a friction coefficient.

Japanese Patent Application Laid-Opens No. 62-122781 and No. 62-146674 disclose recording material for ink jet recording with an ink-accepting layer containing polymer complexes comprising basic polymers and acidic polymers. In this technology, however, since both polymers are dissolved in organic solvents such as dimethylformamide and employed as coating liquid, it is difficult to apply to general printing paper. In addition, material for ink jet recording is required to have acceptability (in other words, absorptivity) for ink jet printing ink comprising a mixture of water and polyalcohols, and it cannot satisfy the requirements of water absorptivity of the present invention.

The present inventors found that newsprint paper in which water absorptivity is improved and surface strength and peelability are also improved in a good balance could be obtained using means of external addition of agents containing a combination of two components, that is, specific polyacrylamides and polymers with anionic hydrophobic group(s) to newsprint paper and completed the present invention.

SUMMARY OF THE INVENTION

Namely, the present invention relates to printing paper, especially newsprint paper provided with a coating layer containing a water absorptivity controlling composition, mainly comprising two Components A and B mentioned below, on the surface of paper. Component A: At least one water-soluble polyacrylamides selected from 1) Nonionic polyacrylamides;

2) Cationic polyacrylamides; and

3) Amphoteric polyacrylamides.

Component B: Anionic copolymer(s) comprising monomer(s) with hydrophobic substitutent(s) and monomers with carboxyl group(s) or sulfonate group(s).

Water absorptivity controlling composition of the present invention is mainly constituted with said Components A and B.

The Components A employed in the water absorptivity controlling composition of the present invention are cationic polyacrylamides ("polyacrylamides" is abbreviated as "PAM" hereinafter) including nonionic PAMs, cationic PAMs, and amphoteric PAMs.

As for the nonionic PAMs employed as the Components A, (meth)acrylamide polymers or copolymers (when "meth" is designated, the designation means that (meth) compounds may exist, thus "(meth)acrylamide" means "methacrylamide and/or acrylamide", the same hereinafter), and copolymers comprising nonionic monomers copolymerizable with (meth)acrylamide and (meth)acrylamide can be exemplified. These PAMs are essentially nonionic, but a part of the amide structure exists in a form of amidinium ion (—CONH3+), thus they are slightly cationic. Therefore, nonionic PAMs can be employed as the Components A in the present invention.

The cationic PAMs and the amphoteric PAMs employed as the Components A are PAMs containing cationic monomer units, desirably those containing tertiary-amine group(s) (or tertiary-amine base(s)) and/or monomer units with quaternary ammonium base(s) as cationic monomer units. PAMs which do not contain anionic monomer units other than cationic monomer units are cationic monomers, while PAMs containing anionic monomer units in addition to cationic monomer units are amphoteric PAM.

Furthermore, the cationic monomer units shown by the following general formulae [1] and [2] are particularly preferable:

[General formula 1]

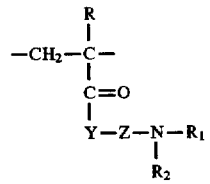

[General formula 2]

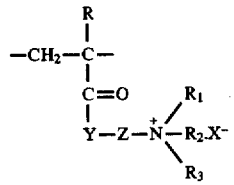

wherein, R represents a methyl group or a hydrogen atom; Y represents NH or an oxygen atom; Z represents CH2CH (OH)CH2 or an alkylene group containing 1–4 carbon atoms; R1, R2, and R3 represent an alkylene group containing 1–18 carbon atoms, benzyl group, or a hydrogen atom; R1, R2, and R3, however, may be the same or different: X ion represents a negative ion and a halogen atom ion (chlorine ion, bromine ion, or iodine ion, etc.), sulfate ion, alkylsulfate ion (methylsulfate ion, ethylsulfate ion, etc.), alkylsulfonate ion, arylsulfonate ion, acetate ion, etc.).

Methods of introducing cationic monomer units into PAMs are, for example, (a) a method to modify various PAMs through Mannich reaction; (b) a method to modify various PAMs through Hoffman degradation reaction; (c) a method to copolymerize monomers with tertiary-amine group or quaternary ammonium base(s); and (d) a method in which monomers with tertiary-amine group(s) are copolymerized followed by conversion to quaternary ammonium base(s) through alkylation, arylation, etc.

For example, since it is sufficient to copolymerize (meth) acrylamide and cationic monomers (monomers containing tertiary-amine group(s) or quaternary-ammonium base(s)' or (meth)acrylamide derivatives and cationic monomers in the method of copolymerization mentioned in (c), copolymers comprising (meth)acrylamide and cationic monomers mentioned below can be employed as the Components A.

Monomers with tertiary-amine group(s) employed in this method are, for example, N,N-dimethylaminoethyl(meth) acrylate, N,N-diethylaminoethyl(meth)acrylate, N,N-dimethylaminopropyl(meth)acrylate, N,N-dimethylaminohydroxypropyl(meth)acrylate, N-methyl, N-ethylaminoethyl(meth)acrylate, N,N-diphenylaminoethyl (meth)acrylate, N,N,-dimethylaminoethyl(meth)acrylamide, N,N-diethylaminopropyl(meth)acrylamide, N,N-dimethyl (meth)acrylamide, N,N-diethyl(meth)acrylamide, 2-vinylpyridine, 4-vinylpyridine, and 2-methyl-5-vinylpiridine. Monomers containing quaternary-ammonium base(s) which can be employed include (meth) acroyloxyethyltrimethylammoniumchloride, (meth) acroyloxyethyldimethylbenzylammonium chloride, (meth) acroyloxyethyltriethylammonium chloride, (meth) acroyloxyethyldiethylbenzylammonium chloride, (meth) acrylamidepropyltrimethylammonium chloride, (meth) acrylamidepropyltriethylammonium chloride, (meth) acrylamidepropldimethylbenzylammonium chloride, diallyidimethylammonium chloride, diallyldiethylammonium chloride, and (meth) acroyloxyethyltrimethylammonium sulfate.

In addition, monomers which can be copolymerized with (meth)acrylamide or cationic monomers mentioned above can be employed in this copolymerization method. That is, copolymer(s) comprising (meth)acrylamide, cationic monomers, and copolymerizable monomers mentioned below can be used as the Components A.

The copolymerizable monomers which can be employed in this method include ethylene, butadiene, styrene, α-methylstyrene, isoprene, propylene, vinyl acetate, vinyl carbazole, vinyl pyrrolidone, (meth)acrylonitrile, (meth) acrylic esters, N-methylol-(meth)acrylamide, methylene bis-acrylamide, 2-hydroxyethyl(meth)acrylate, 2-hydroxypropyl(meth)acrylate, 2-sulfoethyl(meth)acrylate, ethylene-di(meth)acrylate, acrylic acid, methacrylic acid, maleic acid, fumaric acid, itaconic acid, muconic acid, crotonic acid, allylglycidylether, glycidyl(meth)acrylate, sodium ethylenesulfonate, sodium p-styrenesulfonate, sulfonium salt of vinylbenzyl, and phosphonium salt of vinylbenzyl. Amphoteric PAMs can be obtained using anionic monomers such as acrylic acid and itaconic acid among these monomers.

Alkylating agents employed in the method of converting tertiary-amine group(s) to quaternary ammonium base(s) in the method (d) are dimethyl sulfate, methyl chloride, methyl bromide, methyl iodide, benzyl chloride, benzyl bromide, etc.

In the present invention, cationic PAMs and amphoteric PAMs are employed more preferably than nonionic PAMs as the Components A to control water absorptivity and to provide water absorptivity, because nonionic PAMs have very weak cationic properties derived from the amidinium structure partially existing and thus they are only slightly effective for providing water absorptivity. In cationic PAMs and amphoteric PAMs, a ratio of cationic monomer units is desirably not less than 0.1 mol %. If a ratio of cationic monomer units is less than 0.1 mol %, the water absorptivity controlling effect tends to decrease slightly. If higher water absorptivity is desired, cationic PAMs are more preferably employed than amphoteric PAMs.

Each PAM of the Components A can be obtained by polymerizing or copolymerizing corresponding monomers by means of conventional, known methods, such as water solution polymerization, solvent polymerization, reverse-phase emulsion polymerization, sedimentation polymerization, and suspension polymerization.

In the present invention, one PAM alone or a mixture of two or more PAMs may be employed as the Components A.

Weight average molecular weight of PAMs employed as the Components A suitably is in a range of 10,000–4,000,000. If average molecular weight is less than 10,000, sufficient coating layer cannot be formed and water absorptivity and surface strength are insufficient. However, if average molecular weight is higher than 4,000,000, viscosity becomes so high that problems in operation may occur and peelability of coated products is not acceptable. Accordingly, it is considered that higher average molecular weight is preferable from the viewpoints of providing water absorptivity and improving surface strength, whereas lower average molecular weight is preferable from the viewpoint of peelability of coated products.

Therefore, average molecular weight of PAMs may be optionally determined according to the required specification within the range mentioned above. Considering water absorptivity, surface strength, and peelability comprehensively, average molecular weight of PAMs is preferably in a range of 50,000–3,000,000, more preferably in a range of 100,000–1,000,000.

The Components B employed in the water absorptivity controlling composition of the present invention are copolymers comprising monomers with hydrophobic substitutent (s) and anionic monomers (monomers with carboxyl group (s) or sulfonate group(s)).

Although the hydrophobic substitutents mentioned above are those containing not less than 6 carbon atoms and they are not particularly restricted, they may be determined considering the problem of foaming of coating material, the required degree of water absorptivity, etc. Alkyl groups containing not less than 6 carbon atoms, alkenyl groups containing not less than 6 carbon atoms, cycloalkyl groups containing not less than 6 carbon atoms, aryl groups containing not less than 6 carbon atoms, and aralkyl groups containing not less than 7 carbon atoms can be mentioned as substitutents.

The above-mentioned monomers containing hydrophobic substitutent(s) include, for example, styrene-type monomers (such as styrene, α-methylstyrene, chlorostyrene, and cyanostyrene), olefin-type monomers (such as hexene, octene, and decene), (meth)acrylic esters, and maleic esters. They are described in detail in "Polymer Handbook: Basis" edited by the Japanese Association of Polymer, Baifu-kan (1986) (examples of styrene-type monomers are listed in Table 5-1 in p. 47, those of olefin-type monomers in Table 1-1 in p. 2, those of acrylic esters in Table 10-1 in p. 105, maleic esters in Table 14-1 in p. 162), among which monomers with hydrophobic substitutents may be selected.

Anionic monomers (monomers with carboxyl group(s) or sulfonate group(s)), the remaining constituents of the Components B are, for example, acrylic acid-type monomers (such as acrylic acid, methacrylic acid, crotonic acid, isocrotonic acid, 2-ethylacrylic acid, and 3-tertiary-butylacrylic acid), maleic acid-type monomers (such as maleic acid, methylmaleic acid, phenylmaleic acid, chloromaleic acid, fumaric acid, itaconic acid, and muconic acid), 2-acrylamidepropanesulfonic acid, 2-acrylamide-n-butanesulfonic acid, 2-acrylamide-n-hexanesulfonic acid, 2-acrylamide-n-octanesulfonic acid, 2-acrylamide-n-dodecanesulfonic acid, 2-acrylamide-2-methylpropanesulfonic acid, 2-acrylamide-2-phenylpropanesulfonic acid, 2-acrylamide-2,4,4-trimethylpentanesulfonic acid, 2-acrylamide-2-(4-chlorophenyl)propanesulfonic acid, 2-methacrylamide-n-tetradecanesulfonic acid, sodium 4-methacrylamidebenzenesulfonate, 2-sulfoethylmethacrylate, p-vinylbenzenesulfonic acid, styrenesulfonic acid, and ethylenesulfonic acid.

In the copolymers of the Components B, a ratio of the above-mentioned monomers with hydrophobic group(s) to the above-mentioned anionic monomers is preferably in a range of 90:10–40:60. Although it is sufficient to employ at least one monomer each with hydrophobic substitutent(s) and anionic monomer, a small amount of anionic or nonionic monomers which can be polymerized with the monomers with hydrophobic substitutent(s) and/or the anionic monomers may be copolymerized as far as they do not disturb the present invention.

Methods of manufacturing the copolymers of the Components B include, for example, water solution polymerization, solvent polymerization, reverse-phase emulsion polymerization, sedimentation polymerization, and suspension polymerization.

The copolymers of the Components B are anionic hydrophilic polymers and have an acid value preferably in a range of 50–500, and more desirably, further restricted to a range of 100–300. If an acid value is less than 50, water-solubility of copolymers is insufficient. If an acid value is larger than 500, anionic strength of copolymers is so strong that it is not suitable for the present invention.

The copolymers of the Components B may have weight-average molecular weight ranging from 1,000 to 3,000,000, more desirably ranging from 1,000 to 100,000. If average molecular weight is less than 1,000, copolymers of the Components C cannot sufficiently form a coating layer and it is not desirable from the viewpoints of surface strength and water absorptivity control. If molecular weight is higher than 3,000,000, problems in operation resulting from high viscosity of coating liquid may occur.

Accordingly, the copolymers of the Components B are specifically styrene/acrylic acid copolymer, styrene/(meth) acrylic acid copolymer, styrene/(meth)acrylic acid/(meth) acrylic ester copolymers, styrene/maleic halfester copolymers, styrene/maleic acid copolymer, styrene/maleic ester copolymers, styrene/2-acrylamide propanesulfonate copolymer, (meth)acrylic acid/(meth)acrylic ester copolymers, α-olefin/maleic acid copolymers, and olefin/acrylic acid copolymers. Among them, styrene/acrylic acid copolymer, styrene/(meth)acrylic acid copolymer, styrene/maleic acid copolymer, and α-olefin/maleic acid copolymers are particularly preferable for providing water absorptivity, and styrene/acrylic acid copolymer and α-olefin/maleic acid copolymers are desirable due to the excellent balance between hydrophilic substitutent(s) and hydrophobic substitutent(s). Thus, styrene/acrylic acid copolymer is the most preferable, taking both factors into consideration comprehensively.

In the water absorptivity controlling composition of the present invention mainly composed of the Components A and B, a composition ratio of each component (weight ratio) is, if restricted, such as that a ratio of the Components A to the Components B (A:B) may be in a range of 20:80–80:20, more desirably, from an economic viewpoint, in a range of 40:60–60:40, although the ratio cannot always be restricted since it depends on the level of required water absorptivity or peelability of newsprint paper manufactured or a coating amount of this composition.

It is sufficient that the water absorptivity controlling composition employed in the present invention basically consists only of the Components A and B. Excellent peelability can be obtained when the composition is coated in amounts in the range mentioned above, probably because the Components B affect peelability. In order to further improve peelability or as measures against adhesion trouble, a small amount of adhesion preventing agents or releasing agent may be added at levels not adversely affecting water absorptivity or not causing foaming upon coating layer. As releasing components, for example, monoalkenyl succinate described in Japanese Patent Publication No. 63-58960, adhesion preventing agents comprising organic fluoro compounds described in Japanese Patent Application Laid-Open No. 6-57688, and adhesion preventing agents containing substitutentd succinic acid and/or succinic acid derivatives as effective components described in Japanese Patent Application Laid-Open No. 6-192995. The adhesion preventing agents are added suitably at levels not higher than 100% (wt %). If they are added at levels exceeding 10%, problems such foaming upon coating may occur.

The water absorptivity controlling composition of the present invention may sometimes contain a small amount of other binder components at levels not adversely affecting peelability. Other binder components are, for example, celluloses such as methylcellulose, ethylcellulose, and carboxymethylcellulose; latex such as styrene-butadiene copolymer, styrene/acrylonitrile copolymer, and styrene/butadiene/acrylic ester copolymers; PVAs such as completely saponified PVA, partially saponified PVA, amide-modified PVA, carboxy-modified PVA, and sulfonate-modified PVA; PAMs such as anionic PAMs; silicone resin, petroleum resins, terpene resin, ketone resins, and coumarone resins. Since PVAs have a tendency towards increasing adhesion strength of moistured paper when coated on paper, special attention should be paid to the amount employed in combination.

The water absorptivity controlling composition of the present invention may include additives such as preservatives, anti-foaming agents, UV-preventing agents, discoloration preventing agents, fluorescent brighteners, viscosity stabilizers, antislipping proofing agents, and fillers as far as they do not affect the present invention.

Although base paper of the present invention is not necessarily restricted to that for newsprint paper, the effects of the present invention are clearly observed for base paper for newsprint paper. Thus, the use of the present invention for newsprint paper is illustrated hereinafter.

Base paper for newsprint paper employed in the present invention is base paper manufactured using mechanical pulp (MP) such as grand pulp (GP), thermo-mechanical pulp (TMP) and semichemical mechanical pulp, and chemical pulp (CP) represented by kraft pulp (KP), and deinked pulp (DIP) obtained by deinking used paper containing the above-mentioned pulp, and recycling pulp obtained by disaggragating loss paper generated from a paper manufacturing process, etc. alone or in a form of a mixture thereof in any ratio. The effects of the present invention are exerted especially on base paper manufactured so as to have a basis weight lower than 46/m$^2$. For base paper with a basis weight not lower than 46/m$^2$, the surface strength is satisfactorily sufficient and a change in size and a reduction in strength due to wetting with water during offset printing are negligible, thus it is not necessary for such paper to improve water absorptivity and surface strength simultaneously by external addition of agents.

The composition ratio of DIP in base paper employed in the present invention may be in any range (0–100%), and preferably in a range of 30–70% owing to the recent trend towards increasing the content of DIP.

The base paper for newsprint paper may contain filler for paper making such as white carbon, clay, silica, talc, titanium oxide, calcium carbonate, synthetic resins (vinyl chloride resins, polystyrene resins, urea/formalin resins, melamine resins, styrene/butadiene copolymer resins); paper strength reinforcing agents such as polyacrylamide polymers, polyvinyl alcohol polymers, cationized starch, urea/formalin resins, and melamine/formalin resins; freeness or yield improving agents such as salts of acrylamide/aminomethylacrylamide copolymers, cationized starch, polyethyleneimine, polyethylene oxide, and acrylamide/sodium acrylate copolymers; adjuvants such as aluminum sulfate, UV preventing agents, and discoloration preventing agents. These agents should be added at levels not deteriorating water absorptivity controlling effects of the water absorptivity controlling composition of the present invention. In any case, base paper should have physical properties enabling printing by an offset printing press, and it is sufficient for base paper to possess physical properties such as tensile strength, tear strength, elongation, etc. comparable to those of usual base paper for newsprint paper.

Although base paper subjected to internal addition of sizing agent can be used as base paper for newsprint paper, the effects of the present invention can be more clearly exhibited when base paper without internal addition of them is employed, since an object of the present invention is to solve problems associated with internal addition. External addition of the water absorptivity controlling composition of the present invention can provide water absorptivity similar to or better than that obtained by internal addition sizing, even without subjecting to internal addition sizing. The water absorptivity controlling composition of the present invention can be sufficiently applied to newsprint paper with a spot water absorbing capacity of less than 10 seconds according to the droplet water absorption degree test mentioned below.

Two methods are known for evaluation of water absorption degree of paper with low sizing properties such as newsprint paper. One is a droplet water absorption degree test according to Japan TAPPI No. 33, in which 1 μl of water is dropped on the surface of paper and the time required to absorb the water drop is then determined. Another method is to determine the contact angle (contact angle method). In the present invention, 5 μl of water was dropped and the contact angle of the water drop was determined after a predetermined length of time (5 seconds) had passed. According to these evaluation methods, as water absorbency becomes higher (water absorption capacity becomes higher), the time required to absorb becomes longer in the spot water absorbing capacity test method and the contact angle becomes greater and is maintained for a longer period in the contact angle method.

According to the present invention, water absorptivity can be controlled within a broad range, for example, 10 seconds to 1,000 seconds according to the droplet water absorption degree test, by providing a coating layer containing the water absorptivity controlling composition of the present invention on newsprint paper. According to the contact angle method, water absorptivity can be controlled in a range of 75°–95°. Water absorptivity of the newsprint paper thus manufactured can be controlled at a predetermined level by varying components and composition ratios of the composition of the present invention and amounts of the composition of the present invention to be coated.

Although the level of water absorbency of newsprint paper manufactured may be optionally determined according to the specification required and is not specifically restricted, the level of water absorbency is more preferably in a range of 20–200 seconds according to the droplet water absorption degree test and in a range of 80°–95° according to the contact angle method.

DETAILED DESCRIPTION OF THE PREFERRED EMBODIMENTS

Printing paper, especially newsprint paper with improved water absorptivity according to the present invention can be obtained by using a coater to coat the water absorptivity controlling composition of the present invention on one or both sides of base paper for printing.

Amounts of the water absorptivity controlling composition of the present invention to be coated should be determined according to a level of water absorptivity required for printing paper to be manufactured and are not specifically restricted. However, based on the object of the present invention, the composition of the present invention exerts effects efficiently when it is coated at 0.05–2.0 g/m$^2$ (a total of solid components of the Components A and B) per one side of paper. If the composition of the present invention is coated at amounts less than 0.05 g/m$^2$, water absorptivity cannot be improved, probably because a sufficient barrier layer cannot be formed by the composition. On the other hand, if an amount to be coated exceeds 2.0 g/m$^2$, peelability merkedly deteriorates. That is, adhesion strength increases, and it is economically inefficient to use such an amount. When application of the composition of the present invention to newsprint paper is considered, it is necessary to improve water absorptivity, surface strength, and peelability in a good balance. Taking these three factors into consideration comprehensively, it is preferable to coat the water absorptivity controlling composition of the present invention at 0.1–0.6 g/m$^2$.

Although the water absorptivity controlling composition of the present invention is coated on base paper for printing paper using a conventional two-roll size press, a bar coater, an air knife coater, a gate roll coater, a blade rod metalling coater, etc., coaters for coating transcription such as a gate roll coater and a blade rod metalling coater are preferable as a coater. The effects of the present invention is significantly exerted especially when a gate roll coater is employed. The gate role coater method has a defect in that sufficient effects for providing water absorptivity cannot be attained using conventional surface sizing agents. However, the composition of the present invention coated at amounts in the above-mentioned range can improve water absorptivity efficiently, even using this system.

Coating liquid mainly comprising the water absorptivity controlling composition of the present invention is very suitable for a gate roll coater. When oxidized starch alone is coated using a gate roll coater, striped patterns generally appear on the coated layer. On the other hand, when the coating liquid of the composition of the present invention is coated, these striped patterns are hardly observed and the coating liquid can be coated more evenly.

When the water absorptivity controlling composition of the present invention is applied not only to general printing paper but also to base paper for newsprint paper, it is desirable to coat the composition on both sides of the paper by a gate roll coater. In such a case, coating by an on-machine coater is preferable from the viewpoint of productivity.

The water absorbency controlling composition of the present invention may be coated on both sides of base paper for newsprint paper at 0.1–0.6 g/m$^2$ by a gate roll coater.

For base paper for newsprint paper, although it is said to be difficult due to unevenness of the surface of the base paper to provide a water absorptive barrier layer on the surface of the base paper by external addition (especially by a gate roll coater system) even at amounts, falling into a range of relatively small amounts, the water absorptivity controlling composition of the present invention can exert its effect in attaining water absorptivity with relatively small amounts of coating.

Although it is known that coating of anionic styrene/acidic monomer copolymers on paper by size press reduces the dynamic/static friction coefficient, in general, the dynamic friction coefficient of the newsprint paper thus manufactured is preferably in a range of 0.40–0.70. The water absorptivity controlling composition of the present invention, however, does not have such a tendency, and when a coating layer containing the water absorptivity controlling composition of the present invention is provided on the surface of printing paper, the friction coefficient is not decreased and special addition of antislipping agents is not necessary.

The water absorptivity controlling composition of the present invention can better improve water absorptivity of a felt side than that of a wire side with a small amount of coating. The newsprint paper using the water absorptivity controlling composition of the present invention can control the level of water absorbency within a broad range, thus it can cope with various kinds of ink used in printing. For example, it is thought that the water absorptivity controlling component of the present invention can be fully applied to printing using special ink such as emulsion ink in which damping water is mixed in oily ink, and ink with high tackiness for waterless lithography.

In general, improvement of newsprint paper is more difficult than that of general printing paper. Therefore, it is difficult to directly apply technology for general printing paper to that for newsprint paper. However, application of technology for newsprint paper to that for general printing paper is relatively easy. Thus, the water absorptivity controlling composition of the present invention can be applied not only to newsprint paper but also to general printing paper to improve water absorptivity, etc.

With the use of the water absorptivity controlling composition of the present invention, printing paper of a variety of brands with different sizing properties can be easily manufactured without the necessity of internal addition sizing, which is apt to cause operational problems, and surface strength can be improved at the same time.

Paper with improved water absorptivity can be obtained by coating the water absorptivity controlling composition of the present invention at 0.05–2.0 g/m$^2$ (for one side) on base paper for printing paper by gate roll coating. Furthermore, newsprint paper suitable for high-speed offset printing in which water absorptivity, surface strength, and peelability are all improved in a good balance can be obtained by coating the composition of the present invention at 0.1–0.6 g/m$^2$ (for one side) on newsprint paper by gate roll coating. Although the mechanism of the exerted effects of the present invention has not been clarified, it is deduced as follows.

It is thought that the water absorptivity controlling composition of the present invention can control water absorbency by forming a hydrophobic complex coating layer when coated on base paper and then dried. The Components A (cationic PAMs) and the Components B (anionic water-soluble polymers with hydrophobic group(s)) form an ionic complex, and finally form a coating in which the hydrophobic substitutent(s) are oriented outward to provide a hydrophobic barrier layer on the surface of paper.

If improvement solely in water absorptivity is sought, it is thought sufficient to use only the Components B. However, it is thought that the Components A effectively retain the Components B ionically or chemically on the surface of paper, thus the Components A work very advantageously on coating formation, leading to improvement of water absorptivity.

In addition, it is thought that the Components A largely contribute to improvement of surface strength as well as to retainment of the Components B.

EXAMPLES

Hereinafter, referring to synthetic examples, examples and comparative examples, the present invention will be described in detail, but it is not limited to these. Parts and % in the description denote weight parts and weight %.

<Synthesis of Various PAM>

[Synthetic example 1] Synthesis of PAM-1

After putting N,N-dimethylamino ethyl methacrylate (7.8 g), 40% acrylamide aqueous solution (168.6 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (2 g) were added to the reaction solution and allowed to react at 85° C. for an hour. Then, after cooling, a polymer (PAM-1) was obtained. The weight-average molecular weight of this polymer was 740,000.

[Synthetic example 2] Synthesis of PAM-2

After putting N,N-dimethylaminopropylacryl amide (7.8 g), 40% acrylamide aqueous solution (168.6 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (2 g) were added to the reaction solution and allowed to react at 85° C. for an hour. Then, after cooling, a polymer (PAM-2) was obtained. The weight-average molecular weight of this polymer was 660,000.

[Synthetic example 3] Synthesis of PAM-3

After putting 80% methacryloyloxyethyl trimethylammonium chloride (7.8 g), 40% acrylamide aqueous solution (168.6 g) and ion exchange water (300 g) into a four-neck flask provided with a reflux condenser and heating the mixed solution to 60° C. in an atmosphere of nitrogen, 1% ammonium persulfate aqueous solution (10 g) and 10% sodium hydrogensulfite aqueous solution (2 g) were added to the reaction solution and allowed to react at 85° C. for an hour. Then, after cooling, a polymer (PAM-3) was obtained. The weight-average molecular weight of this polymer was 740,000.

[Synthetic example 4] Synthesis of PAM-4

After putting 60% methacryloyloxyethyldimethyl benzylammonium chloride (22.5 g), 40% acrylamide aqueous solution (168.6 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (2 g) were added to the reaction solution and allowed to react at 85° C. for an hour. Then, after cooling, a polymer (PAM4) was obtained. The weight-average molecular weight of this polymer was 820,000.

[Synthetic example 5] Synthesis of PAM-5

After putting 60% acrylamide propyl dimethyl benzylammonium chloride (23.6 g), 40% acrylamide aqueous solution (168.6 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (2 g) were added to the reaction solution and allowed to react at 85° C. for an hour. Then, after cooling, a polymer (PAM-5) was obtained. The weight-average molecular weight of this polymer was 620,000.

[Synthetic example 6] Synthesis of PAM-6

After putting 60% acrylamide propyl dimethyl benzylammonium chloride (23.6 g), 40% acrylamide aqueous solution (168.6 g) and ion exchange water (300 g) into a four-neck flask provided with a reflux condenser and heating the mixed solution to 60° C. in an atmosphere of nitrogen, 1% ammonium persulfate aqueous solution (5 g) and 1% sodium hydrogensulfite aqueous solution (2 g) were added to the reaction solution and allowed to react at 85° C. for an hour. Then, after cooling, a polymer (PAM-6) was obtained. The weight-average molecular weight of this polymer was 50,000.

[Synthetic example 7] Synthesis of PAM-7

After putting 80% methacryloyloxyethyl trimethylammonium chloride (5.2 g), 40% acrylamide aqueous solution (174.0 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aquous solution (2 g) were added to the reaction solution and allowed to react at 85° C. for an hour. Then, after cooling, a polymer (PAM-7) was obtained. The weight-average molecular weight of this polymer was 1,040,000.

[Synthetic example 8] Synthesis of PAM-8

After putting 60% methacryloyloxyethyl dimethyl benzylammonium chloride (9.0 g), 40% acrylamide aqueous solution (174.0 g) and ion exchange water (300 g), into a four-neck flask provided with a reflux condenser and heating the mixed solution to 60° C. in an atmosphere of nitrogen, 1% ammonium persulfate aqueous solution (10 g) and 10% sodium hydrogensulfite aqueous solution (2 g) were added to the reaction solution and allowed to react at 85° C. for an hour. Then, after cooling, a polymer (PAM-8) was obtained. The weight-average molecular weight of this polymer was 1,480,000.

[Synthetic example 9] Synthesis of PAM-9

After putting 60% acrylamide propyl dimethyl benzylammonium chloride (9.4 g), 40% acrylamide aqueous solution (174.0 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (2 g) were added to the reaction solution and allowed to react at 85° C. for an hour. Then, after cooling, a polymer (PAM-9) was obtained. The weight-average molecular weight of this polymer was 1,050,000.

[Synthetic example 10] Synthesis of PAM-10

After putting 80% methacryloyloxyethyl trimethylammonium chloride (5.2 g), itaconic acid (2.6 g), 40% acrylamide aqueous solution (170.4 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (2 g) were added to the reaction solution and allowed to react at 85° C. for an hour. Then, after cooling, a polymer (PAM-10) was obtained. The weight-average molecular weight of this polymer was 600,000.

[Synthetic example 11] Synthesis of PAM-11

After putting 60% methacryloyloxyethyl dimethyl benzylammonium chloride (9.0 g), itaconic acid (2.6 g), 40% acrylamide aqueous solution (170.4 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (2 g) were added to the reaction solution and allowed to react at 85° C. for an hour. Then, after cooling, a polymer (PAM-11) was obtained. The weight-average molecular weight of this polymer was 520,000.

[Synthetic example 12] Synthesis of PAM-12

After putting 60% acrylamide propyl dimethyl benzylammonium chloride (9.4 g), itaconic acid (2.6 g), 40% acrylamide aqueous solution (170.4 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (2 g) were added to the reaction solution and allowed to react at 85° C. for an hour. Then, after cooling, a polymer (PAM-12) was obtained. The weight-average molecular weight of this polymer was 560,000.

[Synthetic example 13] Synthesis of PAM-13

After putting 60% methacryloyloxyethyl trimethylammonium chloride (22.5 g), 80% acrylic acid (4.5 g), 40% acrylamide aqueous solution (160.0 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (2 g) were added to the reaction solution and allowed to react at 85° C. for an hour. Then, after cooling, a polymer (PAM-13) was obtained. The weight-average molecular weight of this polymer was 680,000.

[Synthetic example 14] Synthesis of PAM-14

After putting 60% acrylamide propyl dimethyl benzylammonium chloride (9.4 g), 80% acrylic acid (1.8 g), 40% acrylamide aqueous solution (170.4 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (2 g) were added to the reaction solution and allowed to react at 85° C. for an hour. Then, after cooling, a polymer (PAM-14) was obtained. The weight-average molecular weight of this polymer was 860,000.

[Synthetic example 15] Synthesis of PAM-15

After putting 40% acrylamide aqueous solution (177.8 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (5 g) were added to the reaction solution. After allowing the reactant mixture to react at 85° C. for an hour, it was cooled to 60° C., and 1% sodium hydroxide aqueous solution (7.0 g), 37% formaldehyde (1.6 g) and 50% dimethyl amine (2.0 g) were added. After conducting the reaction again, a polymer (PAM-15) was obtained. The weight-average molecular weight of this polymer was 900,000.

[Synthetic example 16] Synthesis of PAM-16

After putting 40% acrylamide aqueous solution (177.8 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (5 g) were added to the reaction solution. After allowing the reactant mixture to react at 85° C. for an hour, it was cooled to 60° C., 1% sodium hydroxide aqueous solution (7.0 g), 37% formaldehyde (3.2 g) and 50% dimethyl amine (4.0 g) were added. After conducting the reaction again, a polymer (PAM-16)

was obtained. The weight-average molecular weight of this polymer was 960,000.

[Synthetic example 17] Synthesis of PAM-17

After putting N,N-dimethylaminoethyl methacrylate (7.8 g), 40% acrylamide aqueous solution (168.6 g) and ion exchange water (300 g) into a four-neck flask provided with a reflux condenser and heating the mixed solution to 60° C. in an atmosphere of nitrogen, 1% ammonium persulfate aqueous solution (7.0 g) and 1% sodium hydrogensulfite aqueous solution (2 g) were added to the reaction solution and allowed to react at 85° C. for 30 min. Then, after cooling, a polymer (PAM-17) was obtained. The weight-average molecular weight of this polymer was 330,000.

[Synthetic example 18] Synthesis of PAM-18

After putting N,N-dimethylaminopropyl acrylamide (7.8 g), 40% acrylamide aqueous solution (168.6 g) and ion exchange water (300 g) into a four-neck flask provided with a reflux condenser and heating the mixed solution to 60° C. in an atmosphere of nitrogen, 1% ammonium persulfate aqueous solution (15 g) and 1% sodium hydrogensulfite aqueous solution (5 g) were added to the reaction solution and allowed to react at 85° C. for 3 hours. Then, after cooling, a polymer (PAM-18) was obtained. The weight-average molecular weight of this polymer was 3,000,000.

[Synthetic example 19] Synthesis of PAM-19

After putting 80% methacryloyloxyethyl trimethylammonium chloride (5.2 g), 40% acrylamide aqueous solution (174.0 g) and ion exchange water (300 g) into a four-neck flask provided with a reflux condenser and heating the mixed solution to 60° C. in an atmosphere of nitrogen, 1% ammonium persulfate aqueous solution (5 g) and 1% sodium hydrogensulfite aqueous solution (2 g) were added to the reaction solution and allowed to react at 85° C. for 30 min. Then, after cooling, a polymer (PAM-19) was obtained. The weight-average molecular weight of this polymer was 200,000.

[Synthetic example 20] Synthesis of PAM-20

After putting 80% methacryloyloxyethyl trimethylammonium chloride (5.2 g), itaconic acid (2.6 g), 40% acrylamide aqueous solution (170.4 g) and ion exchange water (300 g) into a four-neck flask provided with a reflux condenser and heating the mixed solution to 60° C. in an atmosphere of nitrogen, 1% ammonium persulfate aqueous solution (15 g) and 1% sodium hydrogensulfite aqueous solution (5 g) were added to the reaction solution and allowed to react at 85° C. for 2 hours. Then, after cooling, a polymer (PAM-20) was obtained. The weight-average molecular weight of this polymer was 1,800,000.

[Synthetic example 21] Synthesis of PAM-21

After putting 60% methacryloyloxyethyl dimethyl benzylammonium chloride (22.5 g), 80% acrylic acid (4.5 g), 40% acrylamide aqueous solution (160.0 g) and ion exchange water (300 g) into a four-neck flask provided with a reflux condenser and heating the mixed solution to 60° C. in an atmosphere of nitrogen, 1% ammonium persulfate aqueous solution (5 g) and 1% sodium hydrogensulfite aqueous solution (2 g) were added to the reaction solution and allowed to react at 85° C. for half an hour. Then, after cooling, a polymer (PAM-21) was obtained. The weight-average molecular weight of this polymer was 180,000.

[Synthetic example 22] Synthesis of PAM-22

After putting 40% acrylamide aqueous solution (177.8 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (2 g) were added to the reaction solution and allowed to react at 85° C. for an hour. Then, after cooling, a polymer (PAM-22) was obtained. The weight-average molecular weight of this polymer was 850,000.

[Synthetic example 23] Synthesis of PAM-23

After putting 40% acrylamide aqueous solution (160.0 g), 40% methacrylamide aqueous solution (17.8 g) and ion exchange water (300 g) into a four-neck flask provided with a reflux condenser and heating the mixed solution to 60° C. in an atmosphere of nitrogen. Next, 1% ammonium persulfate aqueous solution (10 g) and 1% sodium hydrogensulfite aqueous solution (2 g) were added to the reaction solution and allowed to react at 85° C. for an hour. Then, after cooling, a polymer (PAM-23) was obtained. The weight-average molecular weight of this polymer was 790,000.

[Synthetic example 24] Synthesis of PAM-24

After putting 80% acrylic acid aqueous solution (5.2 g), 40% acrylamide aqueous solution (174.0 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (2 g) were added to the reaction solution and allowed to react at 85° C. for an hour. Then, after cooling, a polymer (PAM-22) was obtained. The weight-average molecular weight of this polymer was 900,000.

[Synthetic example 25] Synthesis of PAM-25

After putting 40% acrylamide aqueous solution (174.0 g) and ion exchange water (300 g) into a four-neck flask provided with a reflux condenser and heating the mixed solution to 60° C. in an atmosphere of nitrogen, 1% ammonium persulfate aqueous solution (10 g) and 1% sodium hydrogensulfite aqueous solution (2 g) were added to the reaction solution and allowed to react at 85° C. for an hour. By hydrolysis with 3% potassium hydroxide aqueous solution, a polymer (PAM-25) was obtained. The weight-average molecular weight of this polymer was 550,000.

<Anionic Copolymer with Hydrophobic Substituent (s)>

With respect to the Component B, the following six types of polymers were used:

B-1: Styrene/maleic acid copolymer wt.av.mol.wt.=1,700

B-2: Styrene/maleic acid copolymer wt.av.mol.wt.=13,000

B-3: Styrene/acrylic acid copolymer wt.av.mol.wt.=39,000 (oxidation number=230)

B-4: Styrene/acrylic acid copolymer wt.av.mol.wt.=19,600 (oxidation number=230)

B-5: Styrene/acrylic acid copolymer wt.av.mol.wt.=39,000 (oxidation number=150)

B-6: α-olefine/maleic acid copolymer wt.av.mol.wt.=25,000

<Preparation of an Coating Liquid >

By adding the aqueous solution of each PAM (Component A) relevant to the present invention and that of an anionic copolymer with hydrophobic substituent(s) (Component B) together at a predetermined ratio, a coating liquid of water absorbency control compound according to the present invention can be easily prepared. A coating liquid that generates an insoluble precipitate in mixing is unfavorable for the present invention.

<Making a Newsprint Base Paper>

35 parts of DIP (deinked pulp), 30 parts of TMP (thermomechanical pulp), 20 parts of GP (grand pulp) and 15 parts of KP (kraft pulp) were mixed and macerated to regulate the freeness at 200. This mixed pulp was manufactured into an unsized and uncalendared newsprint base paper at the rate of 900 m/min by using a Bervet former paper machine. This base paper is 43 g/m$^2$ in weight, 0.65 in density, 51% in brightness, 60 sec in smoothness, 0.45 in static friction coefficient and 0.56 in dynamic friction coefficient, which is equal to water absorbency in all other paper properties (e.g., strength) to a general newsprint paper. In addition, this base paper contains no added internal sizing agent and exhibits a water absorbency of 5 sec by the droplet water absorbency degree test method.

<Preparing a Newsprint Paper>

[Examples 1 to 138]

By adding the aqueous solution of anionic copolymers (B-1 to B-6) with hydrophobic substituent(s) to the aqueous solution of various PAMs (PAM-1 to PAM-23) at the mixing ratio of 1:1 (solid portion weight ratio), a coating solution of a predetermined concentration was prepared. The obtained coating solution was applied to the above newsprint base paper in the coated amount of 0.8 to 2.0 g/m$^2$ by using a Mayor bar. After the application, a newsprint paper was obtained by calendaring.

[Comparative Examples 1 to 18]

By adding the aqueous solution of anionic copolymers (B-1 to B-6) with hydrophobic substituent(s) to the aqueous solution of various PAMs (PAM-24 to PAM-25) at the mixing ratio of 1:1 (solid portion weight ratio), a coating solution of a predetermined concentration was prepared. The obtained coating solution was applied to the above newsprint base paper in the coated amount of 0.8 to 2.0 g/m$^2$ by using a Mayor bar. After the application, a newsprint paper was obtained by calendaring.

Singly from solutions of anionic copolymers (B-1 to B-6) with hydrophobic substituents, painting solutions were applied to the above newsprint base paper in the coated amount of 0.8 to 2.0 g/m$^2$ by using a Mayor bar. After the application, newsprint paper was obtained by calendaring.

[Comparative Examples 19 to 43]

Singly from solutions of various PAMs (PAM-1 to PAM-23), painting solutions of a predetermined concentration were prepared. The obtained painting solutions were applied to the above newsprint base paper in the coated amount of 0.8 to 2.0 g/m$^2$ by using a Mayor bar. After the application, newsprint paper was obtained by calendaring.

On the newsprint papers of examples 1 to 138 and comparative examples 1 to 43, the water droplet absorption degree of the felt surface was measured. The results are summarized in Tables 1 to 7. Measurement of droplet water absorption degree:

according to Japan TAPPI No. 33 (Test Method for Water Absorbing Rate in an Absorbent Paper), tests were carried out by using 1 μl of droplet water amount.

Incidentally, in droplet water absorption degree, ">300 signifies that the droplet water absorption degree is more than 300 sec."

TABLE 1

| Example No. | Type of PAM (Component A) | Type of anionic materials (Component B) | Spot water absorbing capacity (sec.) |
|---|---|---|---|
| Embodiment 1 | PAM-1 | B-1 | 57 |
| Embodiment 2 | PAM-2 | B-1 | 27 |
| Embodiment 3 | PAM-3 | B-1 | 26 |
| Embodiment 4 | PAM-4 | B-1 | 46 |
| Embodiment 5 | PAM-5 | B-1 | 25 |
| Embodiment 6 | PAM-6 | B-1 | 21 |
| Embodiment 7 | PAM-7 | B-1 | 82 |
| Embodiment 8 | PAM-8 | B-1 | >300 |
| Embodiment 9 | PAM-9 | B-1 | >300 |
| Embodiment 10 | PAM-10 | B-1 | 27 |
| Embodiment 11 | PAM-11 | B-1 | 23 |
| Embodiment 12 | PAM-12 | B-1 | 35 |
| Embodiment 13 | PAM-13 | B-1 | 28 |
| Embodiment 14 | PAM-14 | B-1 | 39 |
| Embodiment 15 | PAM-15 | B-1 | 161 |
| Embodiment 16 | PAM-16 | B-1 | >300 |
| Embodiment 17 | PAM-17 | B-1 | 37 |
| Embodiment 18 | PAM-18 | B-1 | 89 |
| Embodiment 19 | PAM-19 | B-1 | 71 |
| Embodiment 20 | PAM-20 | B-1 | 38 |
| Embodiment 21 | PAM-21 | B-1 | 21 |
| Embodiment 22 | PAM-22 | B-1 | 22 |
| Embodiment 23 | PAM-23 | B-1 | 20 |
| Comparative example 1 | PAM-24 | B-1 | 7 |
| Comparative example 2 | PAM-25 | B-1 | 7 |
| Comparative example 3 | None | B-1 | 9 |

TABLE 2

| Example No. | Type of PAM (Component A) | Type of anionic materials (Component B) | Spot water absorbing capacity (sec.) |
|---|---|---|---|
| Embodiment 24 | PAM-1 | B-2 | 67 |
| Embodiment 25 | PAM-2 | B-2 | 26 |
| Embodiment 26 | PAM-3 | B-2 | 29 |
| Embodiment 27 | PAM-4 | B-2 | 44 |
| Embodiment 28 | PAM-5 | B-2 | 28 |
| Embodiment 29 | PAM-6 | B-2 | 22 |
| Embodiment 30 | PAM-7 | B-2 | 102 |
| Embodiment 31 | PAM-8 | B-2 | >300 |
| Embodiment 32 | PAM-9 | B-2 | >300 |
| Embodiment 33 | PAM-10 | B-2 | 25 |
| Embodiment 34 | PAM-11 | B-2 | 25 |
| Embodiment 35 | PAN-12 | B-2 | 39 |
| Embodiment 36 | PAM-13 | B-2 | 28 |
| Embodiment 37 | PAM-14 | B-2 | 47 |
| Embodiment 38 | PAM-15 | B-2 | 159 |
| Embodiment 39 | PAM-16 | B-2 | >300 |
| Embodiment 40 | PAM-17 | B-2 | 48 |
| Embodiment 41 | PAM-18 | B-2 | 96 |
| Embodiment 42 | PAM-19 | B-2 | 68 |
| Embodiment 43 | PAM-20 | B-2 | 38 |
| Embodiment 44 | PAM-21 | B-2 | 22 |
| Embodiment 45 | PAM-22 | B-2 | 20 |
| Embodiment 46 | PAM-23 | B-2 | 20 |
| Comparative example 4 | PAM-24 | B-2 | 6 |
| Comparative example 5 | PAM-25 | B-2 | 7 |
| Comparative example 6 | None | B-2 | 10 |

TABLE 3

| Example No. | Type of PAM (Component A) | Type of anionic materials (Component B) | Spot water absorbing capacity (sec.) |
|---|---|---|---|
| Embodiment 47 | PAM-1 | B-3 | >300 |
| Embodiment 48 | PAM-2 | B-3 | 84 |
| Embodiment 49 | PAM-3 | B-3 | >300 |
| Embodiment 50 | PAM-4 | B-3 | >300 |

TABLE 3-continued

| Example No. | Type of PAM (Component A) | Type of anionic materials (Component B) | Spot water absorbing capacity (sec.) |
|---|---|---|---|
| Embodiment 51 | PAM-5 | B-3 | 133 |
| Embodiment 52 | PAM-6 | B-3 | 114 |
| Embodiment 53 | PAM-7 | B-3 | >300 |
| Embodiment 54 | PAM-8 | B-3 | >300 |
| Embodiment 55 | PAM-9 | B-3 | >300 |
| Embodiment 56 | PAM-10 | B-3 | 82 |
| Embodiment 57 | PAM-11 | B-3 | 93 |
| Embodiment 58 | PAM-12 | B-3 | >300 |
| Embodiment 59 | PAM-13 | B-3 | >300 |
| Embodiment 60 | PAM-14 | B-3 | >300 |
| Embodiment 61 | PAM-15 | B-3 | >300 |
| Embodiment 62 | PAM-16 | B-3 | >300 |
| Embodiment 63 | PAM-17 | B-3 | 280 |
| Embodiment 64 | PAM-1B | B-3 | 70 |
| Embodiment 65 | PAM-19 | B-3 | >300 |
| Embodiment 66 | PAM-20 | B-3 | 90 |
| Embodiment 67 | PAM-21 | B-3 | >300 |
| Embodiment 68 | PAM-22 | B-3 | >300 |
| Embodiment 69 | PAM-23 | B-3 | 184 |
| Comparative example 7 | PAM-24 | B-3 | 7 |
| Comparative example 8 | PAM-25 | B-3 | 8 |
| Comparative example 9 | None | B-3 | 10 |

TABLE 4

| Example No. | Type of PAM (Component A) | Type of anionic materials (Component B) | Spot water absorbing capacity (sec.) |
|---|---|---|---|
| Embodiment 70 | PAM-1 | B-4 | >300 |
| Embodiment 71 | PAM-2 | B-4 | 117 |
| Embodiment 72 | PAM-3 | B-4 | 93 |
| Embodiment 73 | PAM-4 | B-4 | >300 |
| Embodiment 74 | PAM-5 | B-4 | 264 |
| Embodiment 75 | PAM-6 | B-4 | 153 |
| Embodiment 76 | PAM-7 | B-4 | >300 |
| Embodiment 77 | PAM-8 | B-4 | >300 |
| Embodiment 78 | PAM-9 | B-4 | >300 |
| Embodiment 79 | PAM-10 | B-4 | 104 |
| Embodiment 80 | PAM-11 | B-4 | 73 |
| Embodiment 81 | PAM-12 | B-4 | >300 |
| Embodiment 82 | PAM-13 | B-4 | >300 |
| Embodiment 83 | PAM-14 | B-4 | >300 |
| Embodiment 84 | PAM-15 | B-4 | >300 |
| Embodiment 85 | PAM-16 | B-4 | >300 |
| Embodiment 86 | PAM-17 | B-4 | 290 |
| Embodiment 87 | PAM-18 | B-4 | 77 |
| Embodiment 88 | PAM-19 | B-4 | >300 |
| Embodiment 89 | PAM-20 | B-4 | 103 |
| Embodiment 90 | PAM-21 | B-4 | >300 |
| Embodiment 91 | PAM-22 | B-4 | 230 |
| Embodiment 92 | PAM-23 | B-4 | 189 |
| Comparative example 10 | PAM-24 | B-4 | 8 |
| Comparative example 11 | PAM-25 | B-4 | 8 |
| Comparative example 12 | None | B-4 | 10 |

TABLE 5

| Example No. | Type of PAM (Component A) | Type of anionic materials (Component B) | Spot water absorbing capacity (sec.) |
|---|---|---|---|
| Embodiment 93 | PAM-1 | B-5 | >300 |
| Embodiment 94 | PAM-2 | B-5 | 128 |
| Embodiment 95 | PAM-3 | B-5 | >300 |
| Embodiment 96 | PAM-4 | B-5 | >300 |
| Embodiment 97 | PAM-5 | B-5 | 263 |
| Embodiment 98 | PAM-6 | B-5 | 34 |
| Embodiment 99 | PAM-7 | B-5 | >300 |
| Embodiment 100 | PAM-8 | B-5 | >300 |

TABLE 5-continued

| Example No. | Type of PAM (Component A) | Type of anionic materials (Component B) | Spot water absorbing capacity (sec.) |
|---|---|---|---|
| Embodiment 101 | PAM-9 | B-5 | >300 |
| Embodiment 102 | PAM-10 | B-5 | 134 |
| Embodiment 103 | PAM-11 | B-5 | 202 |
| Embodiment 104 | PAM-12 | B-5 | >300 |
| Embodiment 105 | PAM-13 | B-5 | >300 |
| Embodiment 106 | PAM-14 | B-5 | >300 |
| Embodiment 107 | PAM-15 | B-5 | >300 |
| Embodiment 108 | PAM-16 | B-5 | >300 |
| Embodiment 109 | PAM-17 | B-5 | >300 |
| Embodiment 120 | PAM-28 | B-5 | 119 |
| Embodiment 111 | PAM-19 | B-5 | >300 |
| Embodiment 112 | PAM-20 | B-5 | 122 |
| Embodiment 113 | PAM-21 | B-5 | >300 |
| Embodiment 114 | PAM-22 | B-5 | 202 |
| Embodiment 115 | PAM-23 | B-5 | 125 |
| Comparative example 13 | PAM-24 | B-5 | 7 |
| Comparative example 14 | PAM-25 | B-5 | 7 |
| Comparative example 15 | None | B-5 | 10 |

TABLE 6

| Example No. | Type of PAM (Component A) | Type of anionic materials (Component B) | Spot water absorbing capacity (sec.) |
|---|---|---|---|
| Embodiment 116 | PAM-1 | B-6 | 47 |
| Embodiment 117 | PAM-2 | B-6 | 125 |
| Embodiment 118 | PAM-3 | B-6 | 29 |
| Embodiment 119 | PAM-4 | B-6 | 113 |
| Embodiment 120 | PAM-5 | B-6 | 210 |
| Embodiment 121 | PAM-6 | B-6 | 50 |
| Embodiment 122 | PAM-7 | B-6 | 20 |
| Embodiment 123 | PAM-8 | B-6 | 42 |
| Embodiment 124 | PAM-9 | B-6 | >300 |
| Embodiment 125 | PAM-10 | B-6 | 33 |
| Embodiment 126 | PAM-11 | B-6 | 82 |
| Embodiment 127 | PAM-12 | B-6 | 123 |
| Embodiment 128 | PAM-13 | B-6 | 69 |
| Embodiment 129 | PAM-14 | B-6 | 114 |
| Embodiment 130 | PAM-15 | B-6 | 72 |
| Embodiment 131 | PAM-16 | B-6 | 217 |
| Embodiment 132 | PAM-17 | B-6 | 48 |
| Embodiment 133 | PAM-18 | B-6 | 122 |
| Embodiment 134 | PAM-19 | B-6 | 23 |
| Embodiment 135 | PAM-20 | B-6 | 37 |
| Embodiment 136 | PAM-21 | B-6 | 66 |
| Embodiment 137 | PAM-22 | B-6 | 20 |
| Embodiment 138 | PAM-23 | B-6 | 20 |
| Comparative example 16 | PAM-24 | B-6 | 7 |
| Comparative example 17 | PAM-25 | B-6 | 8 |
| Comparative example 18 | None | B-6 | 10 |

TABLE 7

| Example No. | Type of PAM (Component A) | Type of anionic materials (Component B) | Spot water absorbing capacity (sec.) |
|---|---|---|---|
| Comparative 19 | PAM-1 | None | 8 |
| Comparative 20 | PAM-2 | None | 8 |
| Comparative 21 | PAM-3 | None | 8 |
| Comparative 22 | PAM-4 | None | 7 |
| Comparative 23 | PAN-5 | None | 6 |
| Comparative 24 | PAM-6 | None | 6 |
| Comparative 25 | PAM-7 | None | 6 |
| Comparative 26 | PAM-8 | None | 7 |
| Comparative 27 | PAN-9 | None | 5 |
| Comparative 28 | PAM-10 | None | 8 |
| Comparative 29 | PAM-11 | None | 7 |
| Comparative 30 | PAM-12 | None | 7 |

TABLE 7-continued

| Example No. | Type of PAM (Component A) | Type of anionic materials (Component B) | Spot water absorbing capacity (sec.) |
|---|---|---|---|
| Comparative 31 | PAM-13 | None | 7 |
| Comparative 32 | PAM-14 | None | 7 |
| Comparative 33 | PAM-15 | None | 6 |
| Comparative 34 | PAM-16 | None | 7 |
| Comparative 35 | PAM-17 | None | 6 |
| Comparative 36 | PAM-18 | None | 6 |
| Comparative 37 | PAM-19 | None | 7 |
| Comparative 38 | PAM-20 | None | 6 |
| Comparative 39 | PAM-21 | None | 5 |
| Comparative 40 | PAM-22 | None | 6 |
| Comparative 41 | PAM-23 | None | 7 |
| Comparative 42 | PAM-24 | None | 5 |
| Comparative 43 | PAM-25 | None | 5 |

As seen from Tables 1 to 7, the following combinations exhibited a water droplet absorption degree above 300 sec, i.e., a high water absorbency:

1) PAM copolymer of acrylamide and N,N-dimethyl acrylate/copolymer of styrene and acrylic acid (e.g., PAM-1/B-3)
2) PAM copolymer of acrylamide and methacryloyl oxyethyl trimethylammonium chloride/copolymer of styrene and acrylic acid (e.g., PAM-3/B-3, PAM-7/B-3)
3) PAM copolymer of acrylamide and methacryloyl oxyethyl dimethyl benzylammonium chloride/copolymer of styrene and acrylic acid (e.g., PAM-4/B-3, PAM-8/B-3)
4) PAM copolymer of acrylamide and methacryloyl oxyethyl dimethyl benzylammonium chloride/copolymer of styrene and maleic acid (e.g., PAM-8/B-1)
5) PAM copolymer of acrylamide and acrylamide propyl dimethyl benzylammonium chloride/copolymer of styrene and maleic acid (e.g., PAM-9/B-1)
6) PAM copolymer of acrylamide and acrylamide propyl dimethyl benzylammonium chloride/copolymer of styrene and acrylic acid (e.g., PAM-9/B-3)
7) PAM copolymer of acrylamide and acrylamide propyl dimethyl benzylammonium chloride/copolymer of α-olefine and maleic acid (e.g., PAM-9/B-6)
8) PAM copolymer of acrylamide and itaconic acid and acrylamid propyl dimethyl benzylammonium chloride/copolymer of styrene and acrylic acid (e.g., PAM-12/B-3)
9) PAM copolymer of acrylamide and itaconic acid and methacryloyl oxyethyl dimethyl benzylammonium chloride/copolymer of styrene and acrylic acid (e.g., PAM-13/B-3)
10) PAM copolymer of acrylamide and acrylic acid and acrylamide propyl dimethyl benzylammonium chloride/copolymer of styrene and acrylic acid (e.g., PAM-14/B-3)
11) Modified PAM by Mannick reaction/copolymer of styrene and acrylic acid (e.g., PAM-15/B-3)
12) Modified PAM by Mannick reaction/copolymer of styrene and maleic acid (e.g., PAM-15/B-1)
13) PAM (homopolymer of acrylamide)/copolymer of styrene and acrylic acid (e.g., PAM-22/B-3)

[Comparative Example 44]

By adding an aqueous solution of an amphoteric PAM (trade name: POLYSTRON 696, available from Arakawa Kogyo K.K.) to an aqueous solution of an anionic PAM (trade name: POLYSTRON 117, available from Arakawa Kogyo K.K.) at the mixing ratio of 1:1 (solid portion weight ratio), a coating solution of a predetermined concentration was prepared. The obtained coating solution was applied to the above newsprint base paper in the coated amount of 0.8 to 2.0 g/m$^2$ by using a Mayor bar. Thereafter, a newsprint paper was obtained by calendaring.

Coated amount: 0.88 g/m$^2$ Droplet water absorption degree: 6 sec

[Examples 139 to 153]

With combinations of PAM/anionic copolymer with hydrophobic substituent(s) in which a high water absorbency is obtained, coating solution of a predetermined concentration were prepared at five mixing ratios (PAM: anionic copolymer=80:20, 60:40, 50:50, 40:60 and 20:80 (solid portion weight ratio)). The obtained coating solution were applied to the above newsprint base paper in the coated amount of 0.8 to 2.0 g/m$^2$ by using a Mayor bar. After application, newsprint paper was obtained by calendaring.

[Comparative examples 44 to 58]

With combinations of PAM/anionic copolymer with hydrophobic substituent(s) in which a high water absorbency is obtained, coating solutions of a predetermined concentration were prepared at two mixing ratios (PAM: anionic copolymer=100:0 and 0:100), that is, with a PAM alone or with an anionic copolymer. The obtained coating solution were applied to the above newsprint base paper in the coated amount of 0.8 to 2.0 g/m$^2$ by using a Mayor bar. After application, newsprint paper was obtained by calendaring.

On the obtained newsprint paper, estimation of the water absorbency time based on the contact angle and measurement of the contact angle after the lapse of 5 sec from the dropping were carried out.

Estimation of the water absorbency time based on the contact angle: After dropping 5 μl of water onto a newsprint paper, the time elapsed from the dropping until the contact angle of this water drop became more than 20 deg. was measured. (unit:sec) In estimating the water absorbency time, ">180 signifies that the water absorbency time is above 180 sec."

Measurement of the contact angle after 5 sec from the dropping: After dropping 5 μl of water onto a newsprint paper, the contact angle after the lapse of 5 sec from the dropping was measured. (unit: deg.) The contact angle was measured by using a Dynamic Absorption Tester 1100DAT (Fibro Co.).

For Examples 139 to 153 and Comparative examples 44 to 58, the estimated results of the water absorbency time based on the contact angle are summarized in Tables 8 and 9.

TABLE 8

Results of Water Absorption Time Measurement by Contact Angle

| Example No. | Combination of Components A and B | Composition ratio of Components A and B 80:20 | 60:40 | 50:50 | 40:60 | 20:80 |
|---|---|---|---|---|---|---|
| Embodiment 139 | PAM-1/B-3 | 164 | 157 | 147 | 124 | 104 |
| Embodiment 140 | PAM-3/B-3 | 54 | 151 | 163 | 141 | 89 |
| Embodiment 141 | PAM-7/B-3 | 120 | >180 | 174 | >180 | 91 |

TABLE 8-continued

Results of Water Absorption Time Measurement by Contact Angle

| Example No. | Combination of Components A and B | Composition ratio of Components A and B 80:20 | 60:40 | 50:50 | 40:60 | 20:80 |
|---|---|---|---|---|---|---|
| Embodiment 142 | PAM-4/B-3 | 48 | >180 | 161 | 138 | 98 |
| Embodiment 143 | PAM-8/B-1 | 79 | 59 | 84 | 35 | 34 |
| Embodiment 144 | PAM-8/B-3 | 126 | 179 | >180 | >180 | 137 |
| Embodiment 145 | PAM-9/B-1 | 112 | 100 | 109 | 34 | 46 |
| Embodiment 146 | PAM-9/B-3 | 88 | >180 | >180 | >180 | 143 |
| Embodiment 147 | PAM-9/B-6 | 101 | 174 | >180 | >180 | 157 |
| Embodiment 148 | PAM-12/B-3 | 173 | 172 | 164 | 130 | 158 |
| Embodiment 149 | PAM-13/B-3 | 171 | >180 | 162 | 159 | 121 |
| Embodiment 150 | PAM-14/B-3 | 115 | 127 | >180 | 157 | 152 |
| Embodiment 151 | PAM-15/B-1 | 77 | 82 | 90 | 80 | 41 |
| Embodiment 152 | PAM-15/B-3 | 98 | 145 | 170 | 110 | 90 |
| Embodiment 153 | PAM-22/B-3 | 80 | 78 | 95 | 78 | 55 |

(Unit: sec.)

TABLE 9

Results of Water Absorption Time Measurement by Contact Angle

| Example No. | Combination of Components A and B | Composition ratio of Components A and B 100:0 | 0:100 |
|---|---|---|---|
| Comparative example 44 | PAM-1/B-3 | 16 | 13 |
| Comparative example 45 | PAM-3/B-3 | 17 | 13 |
| Comparative example 46 | PAM-7/B-3 | 12 | 13 |
| Comparative example 47 | PAM-4/B-3 | 16 | 13 |
| Comparative example 48 | PAM-8/B-1 | 15 | 15 |
| Comparative example 49 | PAM-8/B-3 | 15 | 13 |
| Comparative example 50 | PAM-9/B-1 | 11 | 15 |
| Comparative example 51 | PAM-9/B-3 | 11 | 13 |
| Comparative example 52 | PAM-9/B-6 | 11 | 17 |
| Comparative example 53 | PAM-12/B-3 | 13 | 13 |
| Comparative example 54 | PAM-13/B-3 | 15 | 13 |
| Comparative example 55 | PAM-14/B-3 | 12 | 13 |
| Comparative example 56 | PAM-15/B-1 | 15 | 15 |
| Comparative example 57 | PAM-15/B-3 | 15 | 13 |
| Comparative example 58 | PAM-22/B-3 | 12 | 13 |

(Unit: sec.)

From Tables 8 and 9, it is found that the components A and B of the present invention do not develop water absorbency separately but only the combination of both components can provide the effect of obtaining water absorbency.

In addition, for Examples 139 to 153 and Comparative 44 to 58, the measured results of the contact angle after the lapse of 5 sec from the dropping are summarized in Tables 10 to 11.

TABLE 10

Results of Measurement of Contact Angle Conducted 5 Seconds After Dropping

| Example No. | Combination of Components A and B | Composition ratio of Components A and B 80:20 | 60:40 | 50:50 | 40:60 | 20:80 |
|---|---|---|---|---|---|---|
| Embodiment 139 | PAM-1/B-3 | 85.6 | 84.9 | 88.7 | 87.4 | 87.8 |
| Embodiment 140 | PAM-3/B-3 | 81.7 | 87.5 | 89.6 | 90.5 | 86.5 |
| Embodiment 141 | PAM-7/B-3 | 86.2 | 89.2 | 90.5 | 92.6 | 86.1 |
| Embodiment 142 | PAM-4/B-3 | 83.8 | 88.9 | 89.6 | 87.5 | 85.3 |
| Embodiment 143 | PAM-8/B-1 | 79.3 | 82.0 | 91.7 | 86.1 | 79.5 |

TABLE 10-continued

Results of Measurement of Contact Angle Conducted 5 Seconds After Dropping

| Example No. | Combination of Components A and B | Composition ratio of Components A and B 80:20 | 60:40 | 50:50 | 40:60 | 20:80 |
|---|---|---|---|---|---|---|
| Embodiment 144 | PAM-8/B-3 | 86.8 | 91.2 | 91.2 | 87.5 | 87.0 |
| Embodiment 145 | PAM-9/B-1 | 83.5 | 84.1 | 86.1 | 86.2 | 80.7 |
| Embodiment 146 | PAM-9/B-3 | 85.8 | 91.8 | 91.3 | 86.6 | 88.7 |
| Embodiment 147 | PAM-9/B-6 | 88.9 | 87.1 | 89.0 | 89.1 | 87.7 |
| Embodiment 148 | PAM-12/B-3 | 83.6 | 90.8 | 91.8 | 84.4 | 88.1 |
| Embodiment 149 | PAM-13/B-3 | 85.7 | 92.3 | 92.2 | 89.2 | 84.8 |
| Embodiment 150 | PAM-14/B-3 | 84.9 | 90.8 | 91.9 | 87.7 | 84.2 |
| Embodiment 151 | PAM-15/B-1 | 86.4 | 86.5 | 87.4 | 86.9 | 79.9 |
| Embodiment 152 | PAM-15/B-3 | 87.0 | 90.9 | 91.1 | 87.0 | 86.2 |
| Embodiment 153 | PAM-22/B-3 | 84.2 | 84.3 | 87.7 | 83.9 | 80.8 |

(Unit: °)

TABLE 11

Results of Measurement of Contact Angle Conducted 5 Seconds After Dropping

| Example No. | Combination of Components A and B | Composition ratio of Components A and B 100:0 | 0:100 |
|---|---|---|---|
| Comparative example 44 | PAM-1/B-3 | 65.9 | 70.5 |
| Comparative example 45 | PAM-3/B-3 | 54.4 | 70.5 |
| Comparative example 46 | PAM-7/B-3 | 56.9 | 70.5 |
| Comparative example 47 | PAM-4/B-3 | 63.3 | 70.5 |
| Comparative example 48 | PAM-8/B-1 | 55.4 | 67.7 |
| Comparative example 49 | PAM-8/B-3 | 55.4 | 70.5 |
| Comparative example 50 | PAM-9/B-1 | 53.9 | 67.7 |
| Comparative example 51 | PAM-9/B-3 | 53.9 | 70.5 |
| Comparative example 52 | PAM-9/B-6 | 53.9 | 69.8 |
| Comparative example 53 | PAM-12/B-3 | 56.5 | 70.5 |
| Comparative example 54 | PAM-13/B-3 | 61.7 | 70.5 |
| Comparative example 55 | PAM-14/B-3 | 61.9 | 70.5 |
| Comparative example 56 | PAM-15/B-1 | 51., | 67.7 |
| Comparative example 57 | PAM-15/B-3 | 51., | 70.5 |
| Comparative example 58 | PAM-22/B-3 | 52.2 | 70.5 |

(Unit: °)

From Tables 10 and 11, it is conjectured for the comparative examples of newsprint papers that the contact angle after the lapse of 5 sec from the dropping has decreased and a deformation of the water drop has occurred. Thus, also from the standpoint of contact angle, it is understood that the examples of newsprint papers are superior in water absorbency.

Furthermore, for Examples 139 to 153, the measured results of water drop absorbency are summarized in Table 12.

TABLE 12

Results of Measurement of Spot Water Absorbing Capacity

| Example No. | Combination of Components A and B | Composition ratio of Components A and B 80:20 | 60:40 | 50:50 | 40:60 | 20:80 |
|---|---|---|---|---|---|---|
| Embodiment 139 | PAM-1/B-3 | 154 | >300 | >300 | 250 | >300 |
| Embodiment 140 | PAM-3/B-3 | 24 | 78 | 30 | >300 | 166 |
| Embodiment 141 | PAM-7/B-3 | 38 | >300 | >300 | >300 | 196 |
| Embodiment 142 | PAM-4/B-3 | 35 | >300 | >300 | >300 | >300 |
| Embodiment 143 | PAM-8/B-1 | 46 | >300 | >300 | 22 | 27 |

TABLE 12-continued

| Example No. | Combination of Components A and B | Results of Measurement of Spot Water Absorbing Capacity: Composition ratio of Components A and B 80:20 | 60:40 | 50:50 | 40:60 | 20:80 |
|---|---|---|---|---|---|---|
| Embodiment 144 | PAM-8/B-3 | 146 | >300 | >300 | >300 | >300 |
| Embodiment 145 | PAM-9/B-1 | 105 | >300 | >300 | 58 | 31 |
| Embodiment 146 | PAM-9/B-3 | 54 | >300 | >300 | >300 | >300 |
| Embodiment 147 | PAM-9/B-6 | 67 | >300 | >300 | >300 | >300 |
| Embodiment 148 | PAM-12/B-3 | >300 | >300 | >300 | >300 | 155 |
| Embodiment 149 | PAM-13/B-3 | 129 | >300 | >300 | >300 | >300 |
| Embodiment 150 | PAM-14/B-3 | 59 | >300 | >300 | 204 | 181 |
| Embodiment 151 | PAM-15/B-1 | 39 | 98 | 147 | 105 | 102 |
| Embodiment 152 | PAM-15/B-3 | 101 | >300 | >300 | >300 | >300 |
| Embodiment 153 | PAM-22/B-3 | 41 | 92 | 133 | 131 | 63 |

(Unit: sec.)

From Tables 8, 10 and 12, some degree of correlation is recognized between the results of the contact angle method (water absorption time based on the contact angle or the contact angle after the lapse of 5 sec from the dropping) and those of the drop water absorption degree method, and therefore estimation of the water absorbency may be performed by either one method alone.

[Comparative Examples 59 to 81]

By adding an aqueous solution of a cationic PAM and an aqueous solution of an anionic PAM (PAM-24, or PAM-25, HARICOAT G-3000 (trade name), available from Harima Kasei K.K. or POLYSTRON 117 (trade name), available from Arakawa Kogyo K.K.) relevant to the present invention at the mixing ratio of 1:1 (solid portion weight ratio), a coating solution of a predetermined concentration was prepared. The obtained coating solution was applied to the above newsprint base paper in the coated amount of 0.8 to 2.0 g/m$^2$ by using a Mayor bar. Thereafter, a newsprint paper was obtained by calendaring.

For Comparative Examples 59 to 81, the measured results of the contact angle after the lapse of 5 sec from the dropping are summarized in Table 13.

TABLE 13

| Example No. | Type of PAM | Type of anionic materials | Contact angle (°) |
|---|---|---|---|
| Comparative example 59 | PAM-1 | PAM-24 | 61.3 |
| Comparative example 60 | PAM-1 | G-3000 | 60.9 |
| Comparative example 61 | PAM-1 | Polystron 117 | 62.0 |
| Comparative example 62 | PAM-3 | PAM-24 | 50.9 |
| Comparative example 63 | PAM-3 | G-3000 | 49.6 |
| Comparative example 64 | PAM-3 | Polystron 117 | 51.5 |
| Comparative example 65 | PAM-4 | PAM-24 | 54.0 |
| Comparative example 66 | PAM-4 | G-3000 | 53.5 |
| Comparative example 67 | PAM-4 | Polystron 117 | 54.0 |
| Comparative example 68 | PAM-7 | PAM-24 | 50.5 |
| Comparative example 69 | PAM-7 | PAM-25 | 50.9 |
| Comparative example 70 | PAM-7 | G-3000 | 48.0 |
| Comparative example 71 | PAM-8 | PAM-24 | 52.3 |
| Comparative example 72 | PAM-8 | G-3000 | 48.0 |
| Comparative example 73 | PAM-9 | PAM-24 | 52.5 |
| Comparative example 74 | PAM-9 | G-3000 | 45.6 |
| Comparative example 75 | PAM-12 | PAM-24 | 54.0 |
| Comparative example 76 | PAM-12 | G-3000 | 49.2 |
| Comparative example 77 | PAM-12 | Polystron 117 | 51.5 |
| Comparative example 78 | PAM-13 | PAM-24 | 53.8 |
| Comparative example 79 | PAM-13 | G-3000 | 50.4 |
| Comparative example 80 | PAM-14 | PAM-24 | 53.6 |
| Comparative example 81 | PAM-14 | G-3000 | 49.5 |

With the combination of a cationic PAM and an anionic PAM relevant to the present invention, the contact angle after the lapse of 5 sec from the dropping is 60 deg. or less, and a simple mixing of cationic PAM and anionic PAM cannot provide the effect of giving the water absorbency. Comparison of Table 11 with Table 13 reveals that the joint use of a cationic PAM relevant to the present invention and an anionic PAM irrelevant to the present invention provides a lower effect of attaining water absorbency than the single use of a cationic PAM relevant to the present invention.

[Examples 154 to 167]

By adding an aqueous solution of anionic copolymer with hydrophobic substituent(s) to an aqueous solution of cationic PAM at a predetermined mixing ratio (solid portion weight ratio), a coating solution of a predetermined concentration was prepared. The obtained coating solution was applied to the F surface of the above newsprint paper by using a gate roll coater. After application, a newsprint paper was obtained by supercalendaring.

[Comparative Examples 82 and 83]

An aqueous solution of a cationic PAM (PAM-1 or PAM-13) was adjusted to a predetermined concentration to make a coating solution. The obtained coating solution was applied to the F surface of the above newsprint paper by using a gate roll coater. After application, a newsprint paper was obtained by supercalendaring.

In Examples 154 to 167 and Comparative examples 82 and 83, the coated amount, drop water absorption degree, contact angle, peeling strength, surface strength A (Print strength by a Pruefbau printing tester) and surface strength B (FRT (Fiber rising test)) were measured. The results are shown in Table 14.

Measuring the coated amount: the content of nitrogen was determined by the Kjeldahl method and converted.

Measurement of drop water absorption degree: according to the method mentioned above.

Measurement of contact angle: according to the method mentioned above. (the contact angle after the lapse of 5 sec from the dropping was measured for 5 μl of dropped liquid).

Measurement of the peeling strength: After cutting two 4×6 cm sheets from a newsprint paper and soaking the coated surface in water at a temperature of 20° C. for 5 sec, both sheets were closely adhered on mutual coated surfaces. Newsprint base papers were overlaid on both outer surfaces, passed between the rollers under a pressure of 50 kg/cm$^2$ and humidified at 25° C. and 60% RH for 24 hours. After a 3×6 cm test piece was prepared, measurement was performed at 30 mm/min tensile speed by a tensile tester.

A higher measured value signifies a greater difficulty in peeling (reversely saying, a stronger adhesion). With a newsprint paper according to the present invention, papers whose peeling strength is 25.0 g/3cm or less were classified in those of "good separability."

Incidentally, "Broken" means that no separation occurred on the adhered surface in separating a sample by a tensile tester but an inter-layer separation phenomenon of the sample itself occurred. In other words, it indicates an adhesion too high to be measured by this method.

Measurement of the surface strength: Two types of measuring methods, i.e., measurement of printing strength by a Pruefbau printing tester and measurement of the FRT (Fiber rising test) were performed and papers with favorable scores in both measured values are judged as "being excellent in surface strength."

Surface strength A (printing strength by a Pruefbau printing tester)

A deep red ink (Dainippon Ink & Chemical Inc.) was put on a rubber roller of a Pruefbau printing tester and applied to a newsprint paper (printed area: 4×20 cm) at a printing pressure of 15 N/m$^2$ and printing speed of 6.0 m/sec. The number of rising fibers in separation of a rubber roller and newsprint paper during the application was counted using a microscope.

A smaller value indicates greater surface strength. With the present invention, papers on which the number of rising fibers is 20 or less are judged as "being excellent in surface strength."

Surface strength B (FRT)

A 300 mm×35 mm sheet was cut from a newsprint paper in the direction of a machine and the number of fuzzy fibers in a definite area (1 m$^2$) longer than 0.1 mm was determined by using a surface analyzer FIBER 1000 (Fibro system AB).

A smaller value indicates a greater surface strength. With a newsprint paper according to the present invention, papers in which the number of fuzzy fibers per 1 m$^2$ is 22 or less are judged as "being excellent in surface strength."

Dynamic friction factor=0.48
Static friction factor=0.57

Base paper of newsprint paper
Dynamic friction factor=0.45
Static friction factor=0.56

Measurement of the dynamic/static friction factor was carried out in accordance with JAPAN TAPPI No. 30-79 (Test method for the friction factor of papers and paperboards).

[Comparative Example 84]

A copolymer of styrene and maleic acid (B-1) was prepared at a predetermined concentration to make a coating solution. The obtained coating solution was applied to the F surface of the above newsprint paper by using a gate roll coater. After application, newsprint paper was obtained by supercalendaring.

Coated amount: 0.60 g/m$^2$ (measured from the difference in oven-dry weight between a coated paper and base paper)

Droplet water absorption degree: 11 sec

Contact angle: 70 deg.

Surface strength A: 42

Surface strength B: 35

[Comparative Example 85]

A copolymer of styrene and acrylic acid (B-3) was prepared at a predetermined concentration to make a coating solution. The obtained coating solution was applied to the F surface of the above newsprint paper by using a gate roll coater. After application, newsprint paper was obtained by supercalendaring.

TABLE 14

| Example No. | Component A | Component B | Composition ratio (A:B) | Coating amount (g/m$^2$) | Spot Water Absorbing Capacity (sec.) | Contact Angle (°) | Peeling Strength (g/3cm) | Surface Strength A | Surface Strength B |
|---|---|---|---|---|---|---|---|---|---|
| Example 154 | PAM-1 | B-3 | 50:50 | 0.55 | >300 | 92 | 23.8 | 5 | 10 |
| Example 155 | PAM-3 | B-3 | 40:60 | 0.49 | >300 | 91 | 20.8 | 6 | 11 |
| Example 156 | PAM-7 | B-3 | 50:50 | 0.40 | >300 | 90 | 18.6 | 6 | 11 |
| Example 157 | PAM-4 | B-3 | 20:80 | 0.29 | 115 | 90 | 10.5 | 15 | 17 |
| Example 158 | PAM-8 | B-1 | 60:40 | 0.41 | >300 | 92 | 19.8 | 6 | 10 |
| Example 159 | PAM-8 | B-3 | 20:80 | 0.72 | >300 | 93 | 17.5 | 7 | 12 |
| Example 160 | PAM-9 | B-1 | 50:50 | 0.42 | 240 | 90 | 19.9 | 7 | 12 |
| Example 161 | PAM-9 | B-3 | 50:50 | 0.21 | 28 | 86 | 12.5 | 12 | 14 |
| Example 162 | PAM-9 | B-6 | 50:50 | 0.33 | 100 | 90 | 14.6 | 10 | 13 |
| Example 163 | PAM-12 | B-3 | 50:50 | 0.50 | >300 | 92 | 23.7 | 6 | 11 |
| Example 164 | PAM-12 | B-6 | 50:50 | 0.30 | >300 | 90 | 20.1 | 9 | 13 |
| Example 165 | PAM-13 | B-3 | 50:50 | 0.33 | 98 | 89 | 18.2 | 10 | 12 |
| Example 166 | PAM-14 | B-3 | 50:50 | 0.52 | >300 | 91 | 23.9 | 6 | 11 |
| Example 167 | PAM-22 | B-3 | 50:50 | 0.47 | 40 | 84 | 20.3 | 8 | 12 |
| Comparative example 82 | PAM-1 | None | 100:0 | 0.48 | 8 | 68 | (Broken) | 6 | 13 |
| Comparative example 83 | PAM-13 | None | 100:0 | 0.42 | 8 | 65 | (Broken) | 7 | 13 |

In addition, with respect to the obtained values of dynamic/static friction factor, no marked change for the worse was expressly observed even if coated with a water-absorbency controlling compound according to the present invention.

By way of examples,

Example 1 60 of newsprint paper
Dynamic friction factor=0.49
Static friction factor=0.62

Example 163 of newsprint paper
Dynamic friction factor=0.48
Static friction factor=0.62

Example 164 of newsprint paper

Coated amount: 0.70 g/m$^2$ (measured from the difference in oven-dry weight between a coated paper and base paper)

Droplet water absorption degree: 12 sec

Contact angle: 72 deg.

Surface strength A: 40

Surface strength B: 36

[Comparative Example 86]

A copolymer of α-olefine and maleic acid (B-6) was prepared at a predetermined concentration to make a coating solution. The obtained coating solution was applied to the F surface of the above newsprint paper by using a gate roll coater. After application, newsprint paper was obtained by supercalendaring.

Coated amount: 0.65 g/m$^2$ (measured from the difference in oven-dry weight between a coated paper and base paper)

Droplet water absorption degree: 11 sec

Contact angle: 69 deg.

Surface strength A: 43

Surface strength B: 37

Dynamic friction factor=0.30 Static friction factor=0.41

[Comparative Example 87]

By adding an aqueous solution of a copolymer of styrene and acrylic acid (B-3) to a liquid glue of oxidized starch (trade name: SK-20, available from Nihon Corn Starch Ltd.) at a mixing ratio of 5:2 (solid portion weight ratio), a coating solution was prepared. The obtained coating solution was applied to the F surface of the above newsprint paper by using a gate roll coater. However, bubbling of coating materials during gate roll coating has noticeable, presenting a problem in coating adaptability. After application, a newsprint paper was obtained by supercalendaring.

Coated amount: 0.50 g/m$^2$.

Droplet water absorption degree: 17 sec

Contact angle: 75 deg.

Peeling strength: "Broken"

Surface strength A: 7 Surface strength B: 11

[Comparative Example 88]

By adding an aqueous solution of a surface sizing agent made of styrene and acrylic acid (trade name: COLOPEARL M-150-9, available from Seiko Kagaku Kogyo K.K.) to a glue liquid of oxidized starch (trade name: SK-20, available from Nihon Corn Starch Ltd.) at a mixing ratio of 5:2 (solid portion weight ratio), a coating solution was prepared. The obtained coating solution was applied to the F surface of the above newsprint paper by using a gate roll coater. However, bubbling of coating materials during gate roll coating was noticeable, presenting a problem in coating adaptability. After application, newsprint paper was obtained by supercalendaring.

Coated amount: 0.54 g/m$^2$

Droplet water absorption degree: 12 sec

Contact angle: 70 deg.

Peeling strength: "Broken"

Surface strength A: 6 Surface strength B: 10

[Comparative Example 89]

By adding an aqueous solution of sodium polymaleate to a liquid glue of cationid starch (trade name: CATO 302, available from National Starch and Chemical Ltd.) at a mixing ratio of 10:1 (solid portion weight ratio) and further adding a dispersed solution of alkyl ketene dimer (trade name: A-8, available from Arakawa Kagaku Kogyo K.K.), a coating solution was prepared. An attempt was made to apply the obtained coating solution to the F surface of the above newsprint paper by using a gate roll coater. However, bubbling of coating materials during gate roll coating was noticeable, thereby sufficiently delaying the process. The coated articles obtained by a short-time coating were subjected to supercalendaring and newsprint paper was obtained.

Mixing ratio: starch/sodium polymaleate/AKD=10/1/1

Coated amount: 0.46 g/m$^2$

Droplet water absorption degree: 17 sec

Contact angle: 75 deg.

Peeling strength: "Broken"

Surface strength A: 9 Surface strength B: 15

Dynamic friction factor=0.22 Static friction factor=0.33

[Example 168]

By adding an aqueous solution of a copolymer of styrene and acrylic acid (B-3) to an aqueous solution of a cationic PAM (PAM-3) at a mixing rate of 1:1 (solid portion weight ratio) and further adding a separating component (sodium salt of an C10- to C16-alkenyl succinate Japan Patent Laid-Open No. 63-58960 Publication)), a coating solution was prepared. The obtained coating solution was applied to the F surface of the above newsprint paper by using a gate roll coater. After application, newsprint paper was obtained by supercalendaring.

Mixing ratio: PAM-3/B-3/separating agent=1/1/0.05

Coated amount: 0.47 g/m$^2$

Droplet water absorption degree: >300 sec

Contact angle: 91 deg.

Peeling strength: 13.5 g/3 cm

Surface strength A: 7 Surface strength B: 11

[Example 169]

By adding an aqueous solution of a copolymer of styrene and maleic acid (B-1) to an aqueous solution of a cationic PAM (PAM-8) at a mixing ratio of 1:1 (solid portion weight ratio) and further adding a separating component (ammonium perfluorooctanate), a coating solution was prepared. The obtained coating solution was applied to the F surface of the above newsprint paper by using a gate roll coater. After application, newsprint paper was obtained by supercalendaring.

Mixing ratio: PAM-8/B-1/separating agent=1/1/0.01

Coated amount: 0.34 g/m$^2$

Droplet water absorption degree: 120 sec

Contact angle: 89 deg.

Peeling strength: 16.2 g/3 cm

Surface strength A: 9 Surface strength B: 16

[Example 170]

By adding an aqueous solution of a copolymer of styrene and acrylic acid (B-3) to an aqueous solution of a cationic PAM (PAM-12) at a mixing ratio of 1:1 (solid portion weight ratio) and further adding a separating component (potassium dodecyl succinate), a coating solution was prepared. The obtained coating solution was applied to the F surface of the above newsprint paper by using a gate roll coater. After application, newsprint paper was obtained by supercalendaring.

Mixing ratio: PAM-12/B-3/separating agent=1/1/0.05

Coated amount: 0.52 g/m$^2$

Droplet water absorption degree: >300 sec

Contact angle: 91 deg.

Peeling strength: 18.0 g/3 cm

Surface strength A: 8 Surface strength B: 12

[Comparative Example 90]

A liquid glue of oxidized starch (trade name: SK-20, available from Nihon Corn Starch Ltd.) was prepared at a predetermined concentration to make a coating solution. The obtained coating solution was applied to the F surface of the above newsprint paper by using a gate roll coater. After application, newsprint paper was obtained by supercalendaring.

Coated amount: 0.77 g/m$^2$

Droplet water absorption degree: 8 sec

Contact angle: 65 deg.

Peeling strength: "Broken"

Surface strength A: 6 Surface strength B: 10

[Comparative Example 91]

By adding a random copolymer of ethylene oxide and propylene oxide to an aqueous solution of PVA (trade name: K-17, available from Denki Kagaku Kogyo K.K.) at a ratio of 5 parts of copolymer to 100 parts of PVA, a coating solution was prepared. The obtained coating solution was applied to the F surface of the above newsprint paper by using a gate roll coater. After application, newsprint paper was obtained by supercalendaring.

Coated amount: 0.65 g/m$^2$

Droplet water absorption degree: 8 sec

Contact angle: 66 deg.

Peeling strength: "Broken"

Surface strength A: 6 Surface strength B: 10

<Application to General Printing Paper>

[Example 171]

By adding an aqueous solution of a copolymer of styrene and acrylic acid (B-3) to an aqueous solution of a cationic PAM (PAM-1) at a mixing rate of 1:1 (solid portion weight ratio), a coating solution was prepared. The obtained coating solution was applied to fine paper (weight: 78 g/m$^2$; droplet water absorption degree: 9 sec) by using a gate roll coater.

After application, newsprint paper was obtained by supercalendaring.

Coated amount: 0.55 g/m$^2$

Droplet water absorption degree: >300 sec

Contact angle: 91 deg.

[Example 172]

By adding an aqueous solution of a copolymer of styrene and acrylic acid (B-3) to an aqueous solution of a cationic PAM (PAM-9) at a mixing ratio of 1:1 (solid portion weight ratio), a coating solution was prepared. The obtained coating solution was applied to fine paper (weight: 78 g/m$^2$; droplet water absorption degree: 9 sec) by using a gate roll coater. After application, newsprint paper was obtained by supercalendaring.

Coated amount: 0.59 g/m$^2$

Droplet water absorption degree: >300 sec

Contact angle: 92 deg.

[Advantages of the Invention]

Coating of a water-absorbency controlling compound according to the present invention by means of a gate roll coater enables printing paper having improved water absorbency and a well-balanced surface strength and separability to be obtained. In particular, newsprint paper suitable for high-speed offset printing can be obtained. In addition, with the newsprint paper according to the present invention, sizing properties can be given only by the external addition of a water-absorbency controlling compound according to the present invention without the need for internally added sizing, and consequently the problems involved with the internal addition of chemicals can be solved. Furthermore, by optional modification of the amount of coating, mixing ratio and type of material, the present invention is applicable to a wide variety of uses.

We claim:

1. A printing paper having a coated surface, said paper having a droplet water absorption degree in the range of 10–1000 seconds, as measured by the time required to absorb 1 μl of water dropped on the coated surface of said paper, or having a contact angle in the range of 80° to 90° when determined 5 seconds after 5 μl of water is dropped on the coated surface of said paper, said paper comprising:

a base paper; and a coating layer formed on said base paper, said coating comprising a water-absorbency controlling composition comprising:

component A which is a water-soluble polyacrylamide selected from the group consisting of cationic polyacrylamides and amphoteric polyacrylamides having cation monomer units containing at least a tertiary amine group or a quaternary ammonium base; and component B which is a water-soluble anionic copolymer of a styrenic monomer and an acid monomer selected from the group consisting of acrylic acid, methacrylic acid, crotonic acid, isocrotonic acid, 2-ethylacrylic acid, 3-tertiary-butylacrylic acid, maleic acid, methylmaleic acid, phenylmaleic acid, cloromaleic acid, fumaric acid, itaconic acid and muconic acid; or a copolymer of an olefinic monomer and an acid monomer selected from the group consisting of maleic acid, methylmaleic acid, phenylmaleic acid, cloromaleic acid, fumaric acid, itaconic acid, and meconic acid;

wherein said coating layer is formed on said base paper in an amount effective to a achieve said droplet water absorption degree or said contact angle; wherein the weight ratio of said component A to said component B is in the range of 20:80 to 80:20.

2. The printing paper according to claim 1, wherein the weight average molecular weight of said polyacrylamides is in the range of 10,000–4,000,000, and the average molecular weight of said anionic copolymer is in the range of 1,000–3,000,000.

3. The printing paper according to claim 1, wherein a combination of Component A and Component B is selected from the group consisting of: acrylamide/N,N-dimethyl acrylate copolymer and styrene/acrylic acid copolymer; acrylamide/methacryloyl oxyethyl trimethylammonium chloride copolymer and styrene/acrylic acid copolymer; acrylamide/methacryloyl oxyethyl dimethyl benzylammonium chloride copolymer and styrene/acrylic acid; acrylamide/methacryloyl oxyethyl dimethyl benzylammonium chloride copolymer and styrene/maleic acid copolymer; acrylamide/acrylamide propyl dimethyl benzylammonium chloride copolymer and styrene/maleic acid copolymer; acrylamide/acrylamide propyl dimethyl benzylammonium chloride copolymer and styrene/acrylic acid copolymer; acrylamide/acrylamide propyl dimethyl benzylammonium chloride copolymer and α-olefine/maleic acid copolymer; acrylamide/itaconic acid/acrylamide propyl dimethyl benzylammonium chloride copolymer and styrene/acrylic acid copolymer; acrylamide//itaconic acid/methacryloyl oxyethyl dimethyl benzylammonium chloride copolymer and styrene/acrylic acid copolymer acrylamide/acrylic acid/acrylamide propyl dimethyl benzylammonium chloride copolymer and styrene/acrylic acid copolymer; polyacrylamide modified by Mannich reaction and styrene/acrylic acid copolymer; polyacrylamide modified by Mannich reaction and styrene/maleic acid copolymer; and homopolymer of acrylamide and styrene/acrylic acid.

4. The printing paper according to claim 1, wherein said styrenic monomer is selected from the group consisting of styrene, α-methylstyrene, chlorostyrene, and cyanostyrene.

5. The printing paper according to claim 1, wherein said olefinic monomer is selected from the group consisting of hexene, octene, and decene.

6. The printing paper according to claim 1, wherein said component B is styrene/acrylic acid copolymer.

7. The printing paper according to claim 1, wherein said component B is α-olefin/maleic acid copolymer.

8. The printing paper according to claim 1, wherein said component B is styrene/maleic acid copolymer.

9. The printing paper according to claim 1, wherein the amount of said water-absorbency controlling composition is in the range of 0.1–0.6 g/m$^2$ for one side.

10. The printing paper according to claim 1, wherein said coating layer is a layer formed by a gate roll coater method.

11. The printing paper according to claim 1, wherein said printing paper is a newsprint paper.

12. The printing paper according to claim 1, which has a water absorption degree of 20–200 seconds.

13. A printing paper having a coated surface, said paper having a droplet water absorption degree in the range of 10–1000 seconds, as measured by the time required to absorb 1 μl of water dropped on the coated surface of said paper, or having a contact angle in the range of 80° to 90° when determined 5 seconds after 5 μl of water is dropped on the coated surface of said paper, said paper comprising:

a base paper; and a coating layer formed on said base paper, said coating consisting essentially of a water-absorbency controlling composition composed of:

component A which is a water-soluble polyacrylamide selected from the group consisting of non-ionic polyacrylamides, cationic polyacrylamides, and amphoteric polyacrylamides, wherein said cationic polyacrylamides and amphoteric polyacrylamides have cation monomer units containing at least a tertiary amine group or a quaternary ammonium base; and component B which is a water-soluble anionic copolymer of a styrenic monomer and an acid monomer selected from the group consisting of acrylic acid, methacrylic acid, crotonic acid, isocrotonic acid, 2-ethylacrylic acid, 3-tertiary-butylacrylic acid, maleic acid, methylmaleic acid, phenylmaleic acid, cloromaleic acid, fumaric acid, itaconic acid and muconic acid; or a copolymer of an olefinic monomer and an acid monomer selected from the group consisting of maleic acid, methylmaleic acid, phenylmaleic acid, cloromaleic acid, fumaric acid, itaconic acid, and meconic acid;

wherein said coating layer is formed on said base paper in an amount effective to a achieve said droplet water absorption degree or said contact angle; wherein the weight ratio of said component A to said component B is in the range of 20:80 to 80:20.

14. The printing paper according to claim 13, wherein said styrenic monomer is selected from the group consisting of styrene, α-methylstyrene, chlorostyrene, and cyanostyrene.

15. The printing paper according to claim 13, wherein said olefinic monomer is selected from the group consisting of hexene, octene, and decene.

* * * * *